US005704064A

United States Patent [19]

van der Sleesen

[11] Patent Number: 5,704,064

[45] Date of Patent: Jan. 6, 1998

[54] GARMENT WITH STRUCTURAL VENT

[75] Inventor: Michael F. van der Sleesen, West Hartford, Conn.

[73] Assignee: Vanson Leathers, Inc., Stoughton, Mass.

[21] Appl. No.: 547,977

[22] Filed: Oct. 25, 1995

Related U.S. Application Data

[63] Continuation-in-part of Ser. No. 384,779, Feb. 6, 1995, Pat. No. 5,507,042, which is a continuation-in-part of Ser. No. 349,269, filed as PCT/US94/04121, Apr. 14, 1994, abandoned.

[51] Int. Cl.[6] ..... A41D 1/02

[52] U.S. Cl. ..... 2/69; 2/108; 2/85; 2/DIG. 1

[58] Field of Search ..... 2/69, DIG. 1, 108, 2/85, 69.5, 87, 93, 94, 79, 272

[56] References Cited

U.S. PATENT DOCUMENTS

| | | |
|---|---|---|
| 308,244 | 11/1884 | Fishel . |
| 1,015,231 | 1/1912 | Jacobs . |
| 1,360,390 | 11/1920 | Gilfillan . |
| 2,010,434 | 8/1935 | Langrock . |
| 2,073,711 | 3/1937 | Robinsohn . |
| 2,079,980 | 5/1937 | Anders . |
| 2,084,173 | 6/1937 | Wexler . |
| 2,114,514 | 4/1938 | York . |
| 2,259,560 | 10/1941 | Glidden . |
| 2,700,769 | 2/1955 | Polchinski . |
| 2,713,168 | 7/1955 | Bagnato . |
| 2,715,226 | 8/1955 | Weiner . |
| 2,989,754 | 6/1961 | Bukspan . |
| 3,054,243 | 7/1962 | Lash et al. . |
| 3,086,215 | 4/1963 | DiPaola . |
| 3,153,793 | 10/1964 | Lepore . |
| 3,213,465 | 10/1965 | Ludwikowski . |
| 3,536,083 | 10/1970 | Reynolds . |
| 3,710,395 | 1/1973 | Spano et al. . |
| 3,761,962 | 10/1973 | Myers . |

(List continued on next page.)

FOREIGN PATENT DOCUMENTS

| | | |
|---|---|---|
| 0 034 518 | 8/1981 | European Pat. Off. . |
| 1209851 | 6/1953 | France . |
| 1220511 | 5/1960 | France . |
| 10-4030 | 3/1935 | Japan . |
| 63-2419 | 1/1988 | Japan . |
| 2-61907 | 9/1990 | Japan . |
| 1671248 | 8/1991 | U.S.S.R. . |
| 16900 | of 1911 | United Kingdom . |

OTHER PUBLICATIONS

Motoport Biker's Lifestyle, Catalog, Jan. 1994.

*Primary Examiner*—Gloria Hale
*Attorney, Agent, or Firm*—Lappin & Kusmer LLP

[57] ABSTRACT

A ventilated garment is provided having at least one substantially non-stretchable outer panel having inner and outer surfaces. The panel has a vent region including one or more openings. A substantially non-stretchable, air permeable material spans the vent region. An air impermeable lining sheet having a central void region is affixed to the inner surface so that the void region is substantially in registration will be vent region and so that the sheet is coupled to the inner surface about those regions. A cover element having a shape substantially corresponding to at least a potion of the vent region is affixed to the air impermeable lining sheet substantially along a first portion of the periphery of the void region. Adjustable closure elements adjustably couple the sides of the cover element to the air impermeable sheet so that the closure element may be selectively positioned to control the effective vent area of the vent region. Alternatively, the cover element can be affixed directly to the inner surface of the outer panel. The garment can further include a vent panel in the rear panel thereof which is adapted for permitting airflow from the interior of the garment to the outside along the principal plane of the vent panel. Airflow through the garment can be controlled with air inflow scoop elements and adjustable closure elements distal and/or proximal to the scoop elements.

50 Claims, 17 Drawing Sheets

U.S. PATENT DOCUMENTS 3,921,224 11/1975 Ingram, III .
4,185,327 1/1980 Markve .
4,408,356 10/1983 Abrams .
4,513,451 4/1985 Brown .
4,608,715 9/1986 Miller et al. .
4,722,099 2/1988 Kratz .
4,731,883 3/1988 Foster .
5,507,042 4/1996 Van Der Sleesen ..... 2/69

FIG. 16
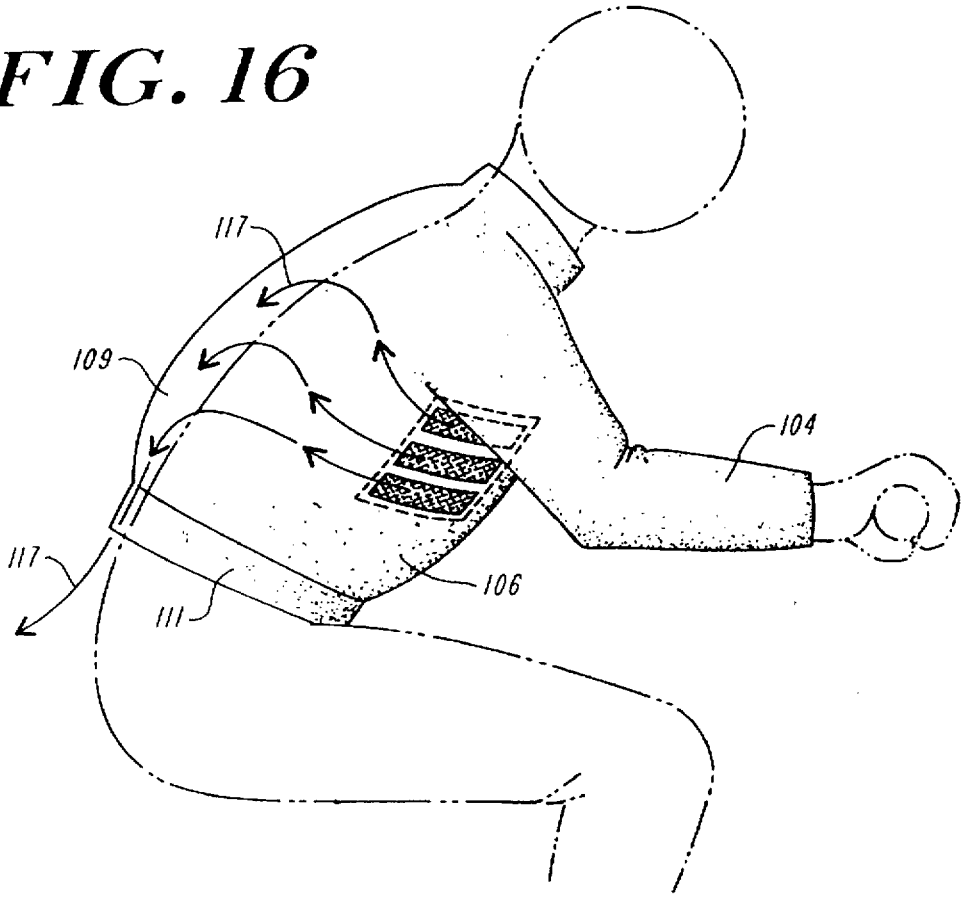
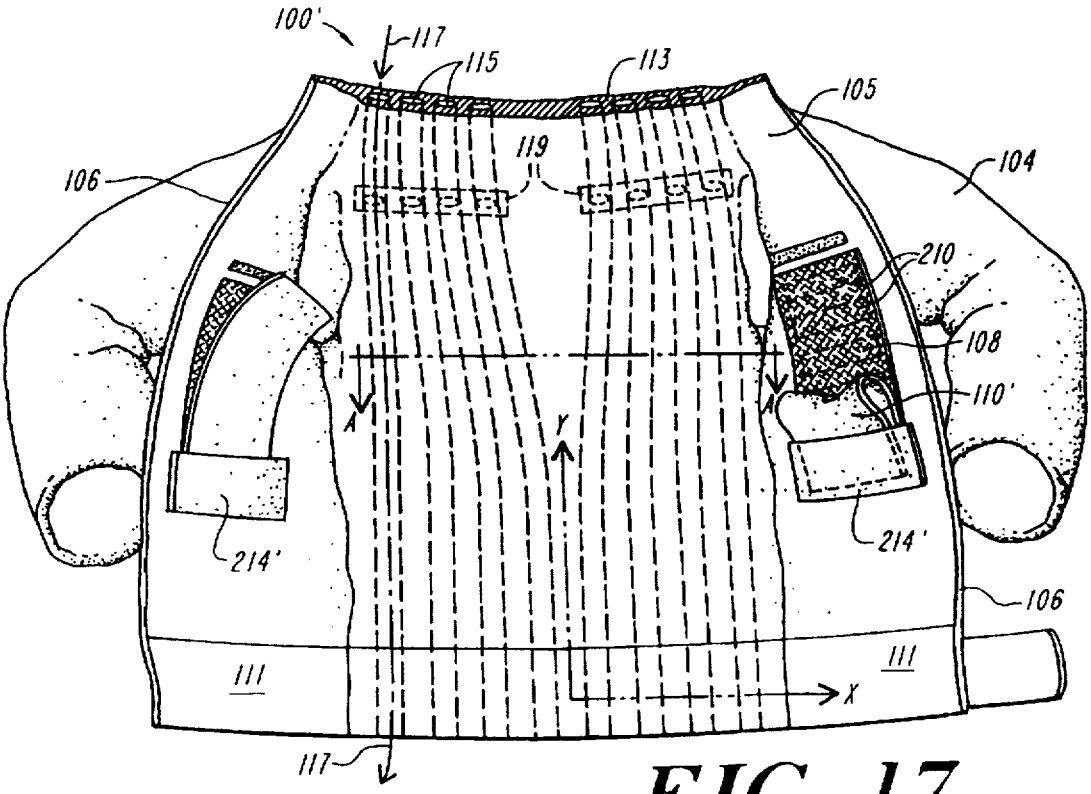
FIG. 17

FIG. 18
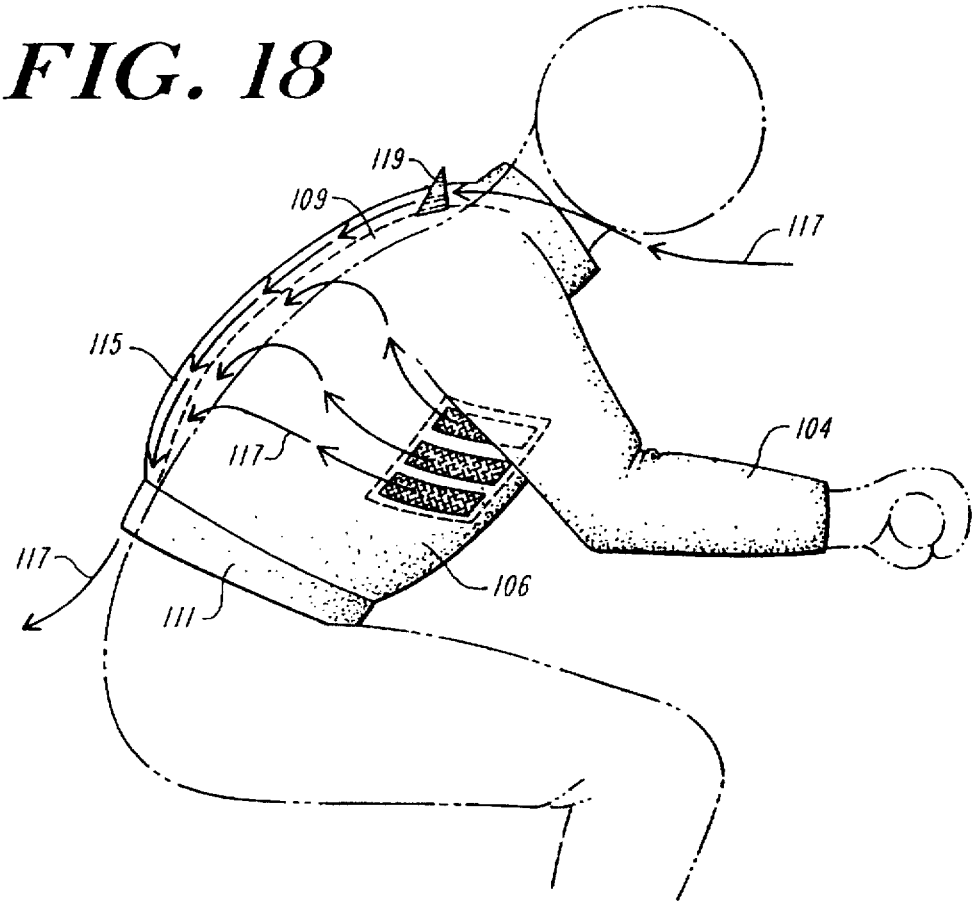
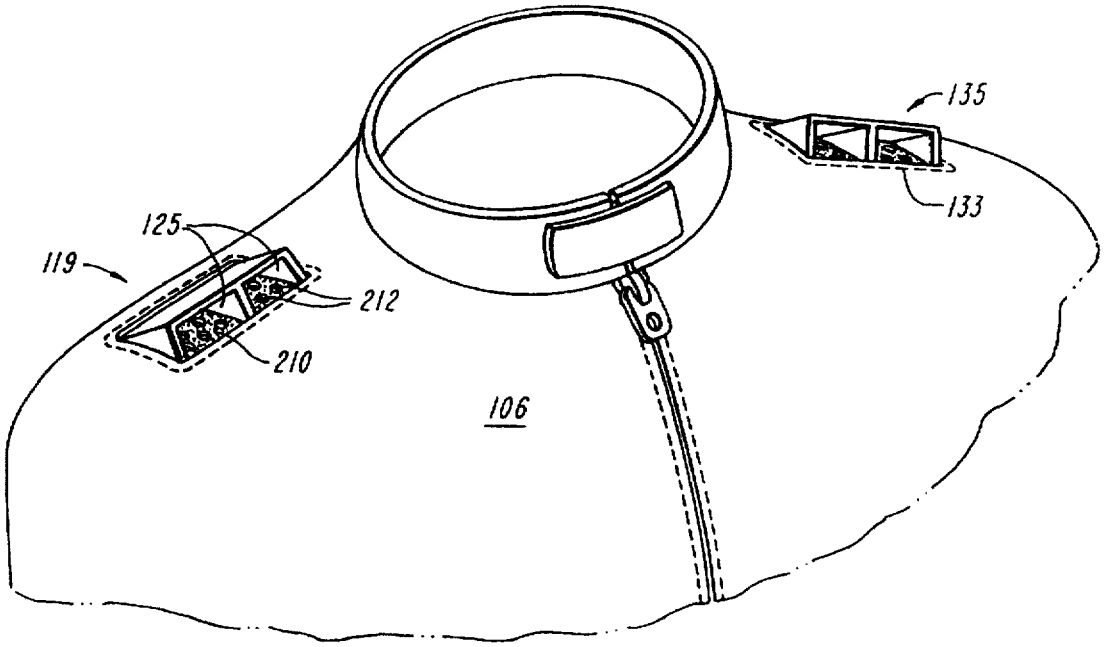
FIG. 19A

FIG. 19B
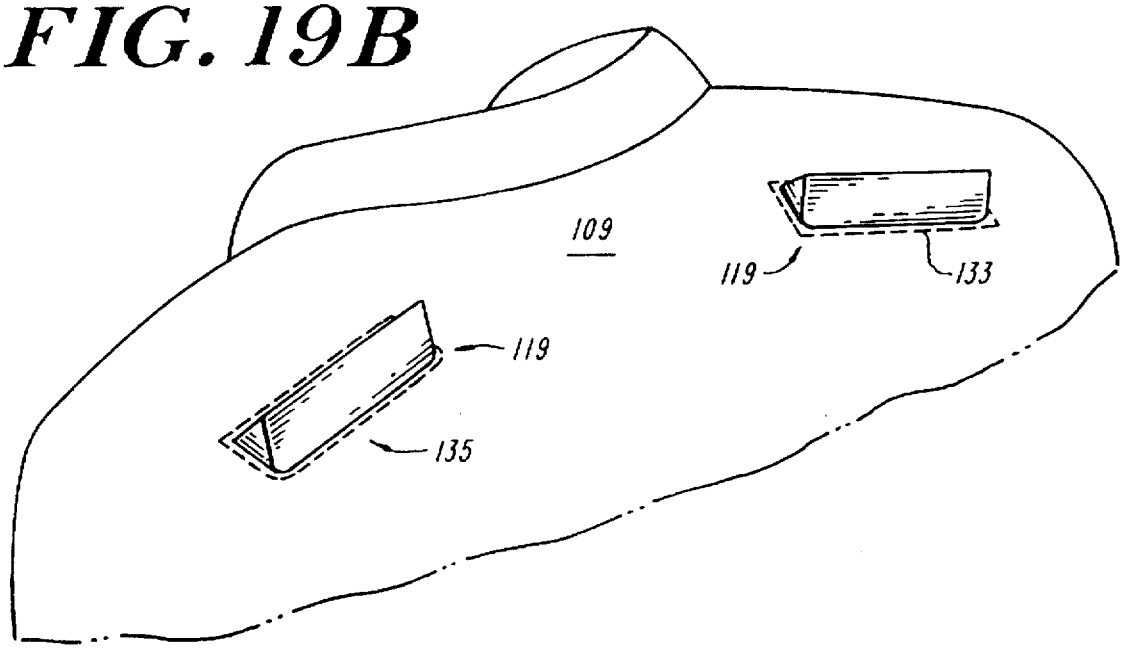
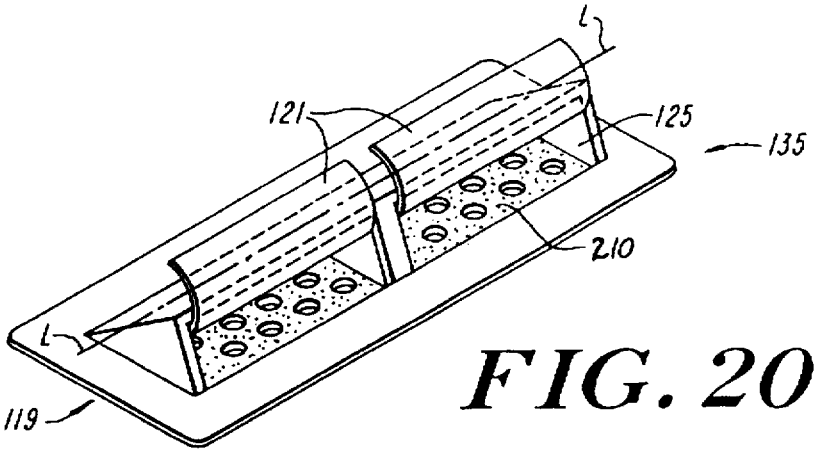
FIG. 20A

GARMENT WITH STRUCTURAL VENT

This application is a continuation-in-part of U.S. application Ser. No. 08/384,779, filed on Feb. 6, 1995, and issued on Apr. 16, 1996 as U.S. Pat. No. 5,507,042 to van der Sleesen which is a continuation-in-part of U.S. application Ser. No. 08/349,269, filed on Dec. 5, 1994, now abandoned which is a continuation-in-part of copending international application Ser. No. PCT/US94/04121, filed on Apr. 14, 1994, and designating the United States as a designated state.

BACKGROUND OF THE INVENTION

When operating fast moving, relatively open vehicles such as motorcycles, bicycles, and some aircraft, the use of protective apparel is important. However, to be useful, protective apparel must be comfortable enough to wear. Many of the garments commonly used for such applications, such as leather suits and jackets, are unacceptably uncomfortable because they provide poor ventilation. Poor ventilation can be a serious problem during warm or moderate weather.

Wearing poorly ventilated protective apparel is uncomfortable on warm days because poor ventilation causes excessive heat buildup. As a result, the wearer may discard the apparel on warm days. Alternatively, the wearer may partially unfasten the front of the garment to provide some ventilation. However, wearing an unfastened garment can be hazardous when traveling at high speed. Air trapped by the opened garment causes billowing or ballooning of the garment and generates unstable forces on the wearer.

Ventilation systems for protective garments are known in the art. For example, U.S. Pat. No. 4,608,715 issued to Miller et al. discloses a vented garment having a linear closure element, e.g., a zipper, provided on the garment, with an air permeable material extending in a rough "C" shape from the edges of the closure element. The vents are adjustably opened by an associated zipper. With the vents opened, the garment would distort in use, providing a poor fit to the wearer. U.S. Pat. No. 4,513,451 issued to Brown discloses a garment with openings that are spanned by a stretchable mesh fabric. Variable closure elements adjustably cover the openings to permit selective control of the effective area of the opening, and thus selective control over the air flow through the opening. The Brown garment does provide effective ventilation; however, because of the stretchable nature of the mesh fabric, it provides a relatively poor fit to the wearer.

U.S. Pat. No. 4,722,099 to Kratz discloses a ventilated protective garment having mesh vents at various locations on the garment, particularly at locations requiring little protection, such as the armpits and throat. Air scoops in the garment allow airflow into the mesh vents and through the garment. The Kratz garment does not, however, permit the wearer to selectively control the amount and location of ventilation.

It is therefore an object of the present invention to provide a protective garment with an improved ventilation system.

It is further an object of the present invention to provide a protective garment having an improved ventilation system with an improved and stable fit to the wearer.

It is also an object of the invention to provide a protective garment having an improved ventilation system that offers increased comfort and greater aesthetic appeal and flexibility of design.

It is a further object of the invention to provide a protective garment with an adjustable ventilation system that provides increased ventilation over the body of the wearer.

It is another object of the invention to provide a protective garment with an adjustable ventilation system that is substantially hidden from view.

Other objects and advantages of the present invention will become apparent upon consideration of the appended drawings and description thereof.

SUMMARY OF THE INVENTION

In one aspect, the invention provides a ventilated garment having at least one substantially non-stretchable front panel and at least one rear panel, in which the front and rear panels each have an opening therein permitting air flow in through the front panel and out through the rear panel. The front panel includes a vent element which is a substantially non-stretchable, air permeable sheet, and has a shape substantially corresponding to the front panel opening. The vent element is affixed to the front panel along the periphery of the front panel opening, thereby spanning that opening. The front panel further includes a cover element having a shape substantially corresponding to the front panel opening. A first portion of the periphery of the cover element is affixed to the front panel substantially along a first portion of the periphery of the front panel opening. A first adjustable closure element adjustably couples a second portion of the periphery of the cover element to the front panel substantially along a second portion of the periphery of the front panel opening, and a second adjustable closure element adjustably couples a third portion of the periphery of the cover element to the front panel substantially along a third portion of the periphery of the front panel opening. The second and third portions of the cover element periphery extend from opposite ends of the first portion of the cover element periphery and the second and third portions of the periphery of the front panel opening extend from opposite ends of the first portion of the periphery of the front panel opening.

In one aspect, the vent panel is provided in the form of perforated material.

In another aspect, the first and second adjustable closure elements are provided in the form of zippers.

In another aspect, a third adjustable closure element adjustably couples a fourth portion of the cover element to a fourth portion of the periphery of the front panel opening. In this aspect, the third closure element can be provided in the form of a hook and loop type fastener, such as a VELCRO™ fastener.

In yet another aspect, the rear panel includes a rear closure element for adjustably closing the rear panel opening. In this aspect the rear closure element can be provided in the form of a zipper. In this aspect the rear panel may also include a substantially non-stretchable vent panel that is affixed to the rear panel substantially under the rear panel opening. In this aspect the rear panel may also include a non-permeable backing flap affixed beneath the zipper and extending over at least a portion of the vent panel.

In another aspect, the cover element does not have a shape corresponding to the front panel opening.

In yet another aspect, the invention provides a ventilated garment having at least one substantially non-stretchable front panel and at least one rear panel, in which the front panel and the rear panel each have an opening therein permitting air flow in the front panel and out the rear panel. The front panel includes a vent element which is a substantially non-stretchable, air permeable sheet having a shape substantially corresponding to the front panel opening. The vent element is affixed to the front panel along the periphery of the front panel opening, thereby spanning that opening. The front panel further includes a cover element. A first portion of the periphery of the cover element is affixed to the front panel along a first curve. A first adjustable closure element adjustably couples a second portion of the periphery of the cover element to the front panel along a second curve, and a second adjustable closure element adjustably couples a third portion of the periphery of the cover element to the front panel along a third curve. The second curve and the third curve extend substantially from opposite ends of the first curve and a fourth curve extends substantially between opposite ends of the second and the third curve distal from the first curve such that the first, second, third, and fourth curves form a periphery that substantially overlies the front panel opening.

In another aspect, the invention provides a ventilated garment comprising at least one substantially non-stretchable outer panel, an air impermeable sheet, a cover element adjustably coupled to the air impermeable sheet with an adjustable closure element, and coupling means for coupling the air impermeable sheet to corresponding portions of the outer panel.

The non-stretchable outer panel has an inner surface and an outer surface and a vent region which includes n openings therein, n being an integer. The outer panel further includes a substantially non-stretchable, air permeable vent material spanning the openings.

The air impermeable sheet has an outer peripheral boundary which defines the outer bounds of the sheet, and an inner peripheral boundary which defines a central void region. In the preferred form of the invention, the central void region corresponds substantially in shape to the shape of the vent region, and further has a surround region which extends omnidirectionally from the central void region to the outer peripheral boundary. The surround region is affixed along the inner peripheral boundary of the void region to the inner surface of the outer panel so that the central void region is substantially in registration with the vent region.

The cover element is defined by a periphery and has a shape which corresponds substantially to the shape of the vent region. At least a first portion of the periphery of the cover element is affixed to the air impermeable sheet substantially along a first portion of the inner peripheral boundary. A first adjustable closure element adjustably couples a second portion of the periphery of the cover element to the air impermeable sheet substantially along a second portion of the inner peripheral boundary. A second adjustable closure element adjustably couples a third portion of the periphery of the cover element to the air impermeable sheet substantially along a third portion of the inner peripheral boundary. The second and third portions of the periphery of the cover element extend substantially from opposite ends of the first portion of the periphery of the cover element. The second and third portions of the inner peripheral boundary extend substantially from opposite ends of the first portion of the inner peripheral boundary.

The coupling means couples the inner peripheral boundary of the air impermeable sheet to correspondingly positioned portions of the inner surface of the outer panel.

In one embodiment the garment includes a third closure element for adjustably coupling a fourth portion of the periphery of the cover element to the air impermeable sheet substantially along a fourth portion of the inner peripheral boundary. The fourth portion of the cover element periphery extends substantially between the second and third portions of the cover element periphery. The fourth portion of the inner peripheral boundary extends substantially between the second and third portions of the inner peripheral boundary.

In still another embodiment, the third closure element adjustably couples the fourth portion of the cover element periphery to the inner surface of the outer panel adjacent to a portion underlying a fourth portion of the inner peripheral boundary.

The third closure element can comprise a hook and loop type fastener, such as a VELCRO™ fastener.

Further, the first, second, third and fourth portions of the inner peripheral boundary substantially comprise the entirety of the periphery of the central void region.

In still another embodiment, the ventilated garment further comprises at least one rear panel, which includes an opening defined by a periphery, and a substantially non-stretchable vent panel affixed to the rear panel substantially along the periphery of the rear panel opening. The rear panel can further include a rear closure element for adjustably closing the rear panel opening. In this embodiment, the rear closure element can be a zipper.

In another embodiment the coupling means can be a hook and loop type fastener, such as a VELCRO™ fastener.

In still another embodiment the ventilated garment further includes a pocket which extends from the surround region substantially adjacent to the first portion of the inner peripheral boundary. The pocket is adapted to receive a portion of the cover element when at least a portion of the vent region is exposed.

The means for affixing the cover element to the air impermeable sheet can be either a removable affixing element or a permanent affixing element.

The ventilated garment construction of the above-described aspect of the invention provides for adjustable, controlled ventilation and enhances the aesthetic appearance and appeal of the garment. Because the vent region can be adjustably covered and uncovered from the inside of the garment, there are no flaps extending from the outside of the jacket to become dislodged during periods of relatively high speed air flow. Further, the hidden adjustable ventilation construction provides greater flexibility in the design of the garment. The outer panel can be scored with one or many vent openings in a wide variety of shapes, sizes and positions relative to one another without compromising either the structural integrity of the garment or its ventilation function.

In another aspect of the invention, there is provided a ventilated garment having at least one substantially non-stretchable outer panel including a vent region with openings in the vent region, and an air impermeable cover element. The outer panel has an inner surface to which the cover panel is affixed along one edge. The other edges of the cover panel are adjustably positionable over the vent openings in the vent region by means of adjustable closure elements which couple the cover panel to the inner surface of the outer panel.

In another aspect of the invention, there is provided a ventilated garment having a front and a back disposable about and defining an interior region. The garment comprises at least one outer front panel which forms at least a portion of the front of the garment, and at least one outer back panel forming at least a portion of the back of the garment. The outer front panel includes a vent for permitting air flow through the outer front panel into the interior region. A vent panel extends from the outer back panel along a principal plane and includes means for establishing an air flow path through the vent panel substantially along its principal plane from the interior region of the garment to parts exterior thereto. The means for establishing an air flow path through the vent panel is a substantially incompressible structure having at least one airflow channel or tube extending through the vent panel along its principal plane.

In one embodiment, the cover panel is affixed to the inner surface of the front panel of the garment. In another embodiment, the cover panel is affixed to an air-impermeable sheet which lines at least a portion of the interior region of the garment.

The ventilated garment of the above-described aspects of the invention combines further design flexibility and aesthetic appeal with enhanced ventilation and improved structural integrity of the garment. Incorporation of a vent panel extending from the rear panel eliminates the need for vent openings in the rear panel of the garment, thereby improving the structural strength, protective features and aesthetic appeal of the rear panel.

BRIEF DESCRIPTION OF THE DRAWINGS

For a fuller understanding of the nature and the objects of the invention, reference should be made to the following detailed description and the accompanying drawings in which like reference numerals refer to like elements and in which:

FIG. 16 is a side view of the garment of FIG. 14, as worn by a user;

FIG. 17 is a front view of the inside of a ventilated garment having a vent panel extending along the full extent of the rear panel;

FIG. 18 is a side view of the garment of FIG. 17, as worn by a user;

FIG. 19A is a perspective view of the front panels of a ventilated garment, in which the outer front panel includes air flow scoop elements;

FIG. 19B is a perspective view of the rear panel of a ventilated garment, in which the rear panel includes airflow scoop elements;

FIGS. 20A–B are perspective views of an air flow scoop element including adjustable closure elements.

DETAILED DESCRIPTION OF THE ILLUSTRATED EMBODIMENT

Figure 1:
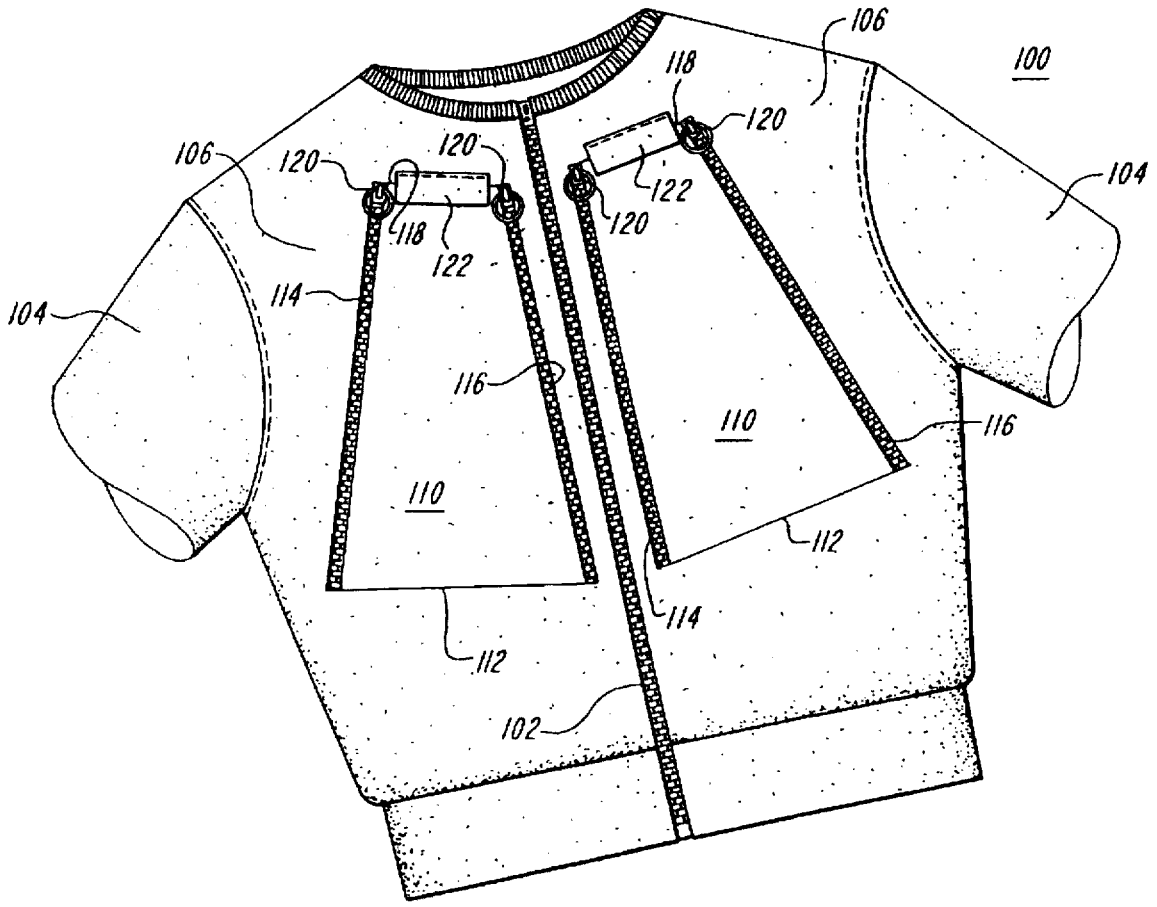
FIG. 1 shows a front view of a jacket according to the present invention.

FIG. 1 shows a front view of a jacket 100 according to the present invention. Jacket 100 is equipped with a central zipper 102, arms 104, and two front panels 106. Each front panel 106 contains an opening 108 (not shown in FIG. 1). Openings 108 are bounded by edges 112, 114, 116, and 118 in the front panels 106. Cover panels or elements 110 are affixed to front panels 106 to adjustably overlie portions of the openings 108. As shown in FIG. 1, the cover panels 110 fully overlie the openings 108 in both panels 106. As described below, the cover elements 110 may be adjusted to fully or partially expose openings 108.

As shown in FIG. 1, the lower portion of cover panel 110 is affixed to front panel 106 along edge 112 at the lower end of opening 108. In the preferred embodiment, cover panel 110 is stitched or otherwise permanently affixed to front panel 106 along edge 112. In other embodiments cover panel 110 may be otherwise fastened to front panel 106 along edge 112 or alternatively, cover panel 110 may be formed from the same piece of material that forms front panel 106.

In the preferred embodiment, cover panel 110 is selectively and adjustably coupled to front panel 106 along edges 114, 116, 118. Zippers 120, or other adjustable couplers such as snaps or buttons, adjustably couple cover panel 110 to front panel 106 along edges 114, 116. Flap 122, extending from from panel 106, adjustably couples cover panel 110 to front panel 106 along edge 118. In the preferred embodiment, flap 122 couples the cover panel 110 to the front panel 106 by use of a hook and loop type fastener, such as a VELCRO™ fastener. In alternative embodiments, flap 122 couples the cover panel 110 to the front panel 106 with buttons, snaps, or other fasteners.

FIG. 1 shows the cover panels 110 completely covering the openings 108. In this configuration relatively little ventilation is provided through openings 108. The jacket is worn in this configuration during cold or bad weather days.

Figure 2:
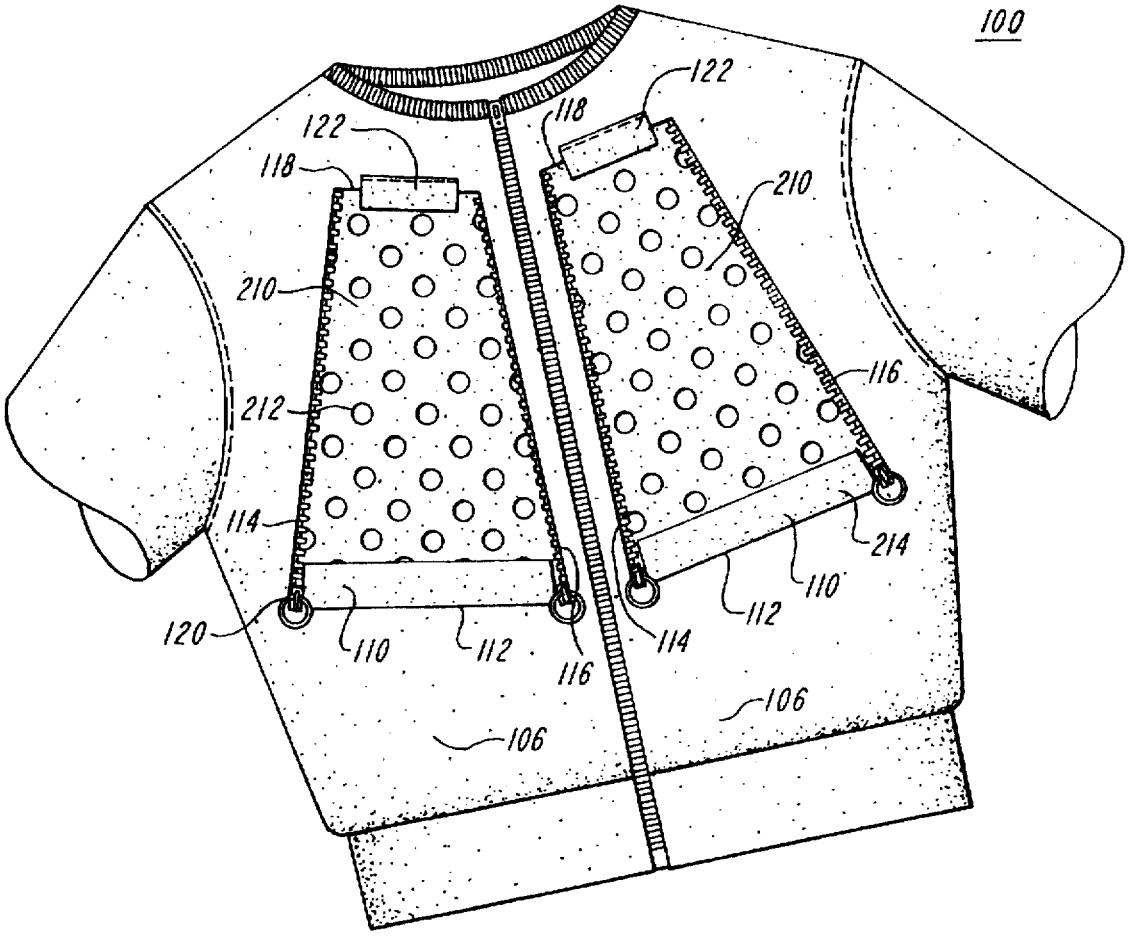
FIG. 2 shows a front view of the jacket of FIG. 1 in which the cover elements are opened.

When ventilation is desired, cover panels 110 can be fully opened to expose ventilation elements 210 shown in FIG. 2. Ventilation elements 210 are fabricated of a relatively non-stretchable, air permeable sheet material, and preferably provide a resistance to stretching forces similar to that which is provided by front panel 106 when the zippers 120 are fully closed. In the preferred embodiment, front panels 106 are constructed of leather or vinyl, and ventilation elements 210 are constructed of perforated leather or vinyl. Other non-permeable materials may be used as well. Perforations 212 provide an air flow path through the vent elements 210.

In FIG. 2, cover panels 110 are shown in a maximally open position. In this configuration, zippers 120 have been maximally opened and the cover panels 110 have been folded into a retracted position. Cover panel 110 may be retracted simply by rolling the fabric of the panel upon itself, or alternatively, the folded panel may be tucked into a specially provided lower pocket 214. As those skilled in the art will readily appreciate, a lesser mount of ventilation can be provided by only partially opening cover panels 110, or by opening only one of the zippers 120 for each panel.

Due to the non-stretchable nature of vent elements 210, a garment according to the invention will retain its shape and provide an improved fit to the wearer, even when the cover panels 110 are maximally open as shown in FIG. 2. Such a shape-retaining adjustably ventilated garment has been heretofore unknown in the art.

Figure 3:
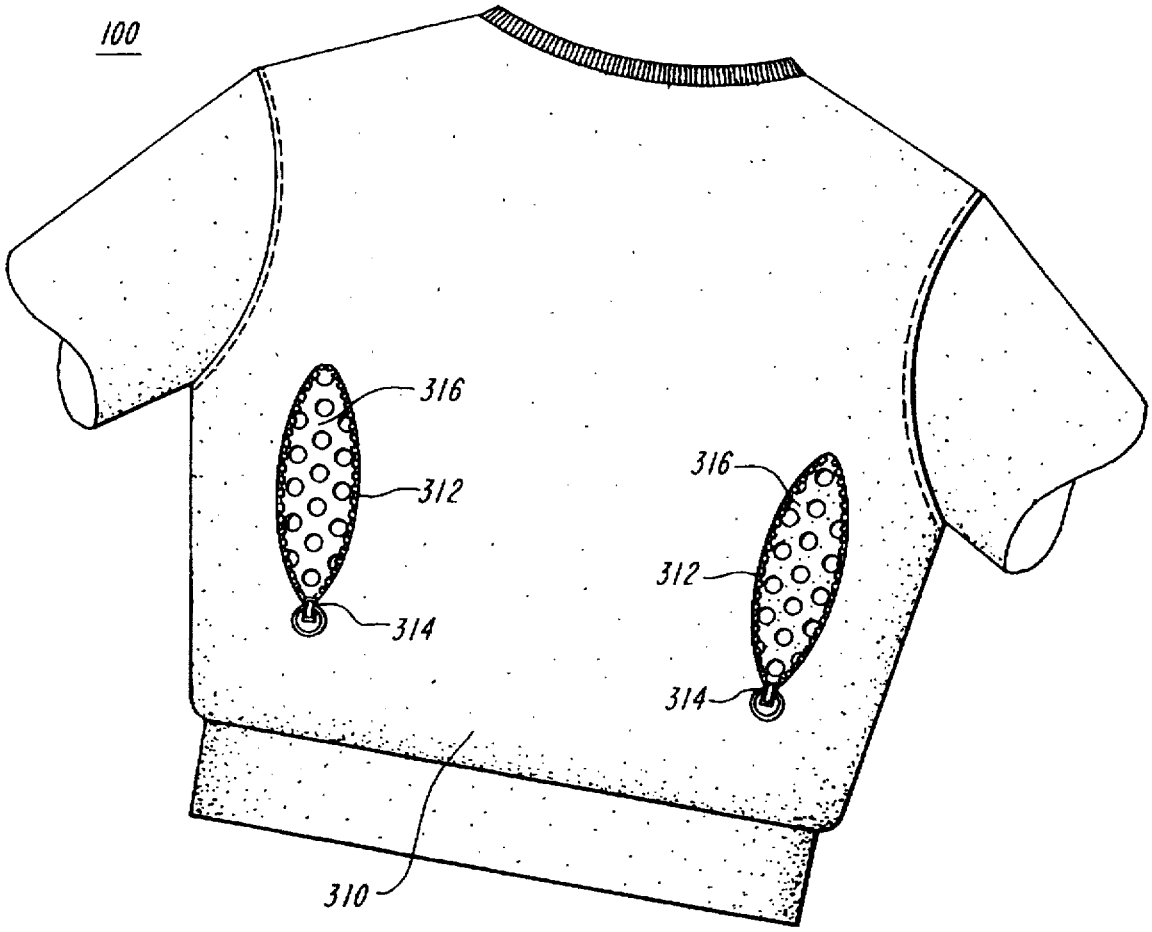
FIG. 3 shows a rear view of the jacket of FIG. 1.

FIG. 3 shows a rear view of jacket 100. In the preferred embodiment, jacket 100 contains a rear panel 310 which contains two openings 312. Openings 312 can be adjustably opened or closed by zippers 314. FIG. 3 shows the zippers 314 in the maximally opened position which exposes vent elements 316, which underlie the zippers 314. In some embodiments, vent elements 316 may be omitted. Preferably, vent elements 316 are constructed of a perforated leather or vinyl similar to that used for front vent elements 210, or may be constructed of other perforated non-permeable materials or from air permeable materials, such as nylon mesh.

The ventilation elements 210, when combined with vents 316 in the rear panels 310 of garment 100, establish an air flow through path permitting an influx of air through vent elements 210 and an outflux of air through vents established by openings 312. Thus opening front vent panels 210 and rear vent openings 312 allow air to pass through jacket 100 and around the body of the wearer (not shown), thus providing ventilation and preventing excessive heat buildup.

The vent regions 108 and cover panels 110 are illustrated in the FIGURES as generally quadrilateral shapes. However, different shapes for each, including those with curvilinear and/or rectilinear peripheries, such as circles, ovals and the like, can also be used and are to be considered as being within the scope of the present invention.

Figure 4:
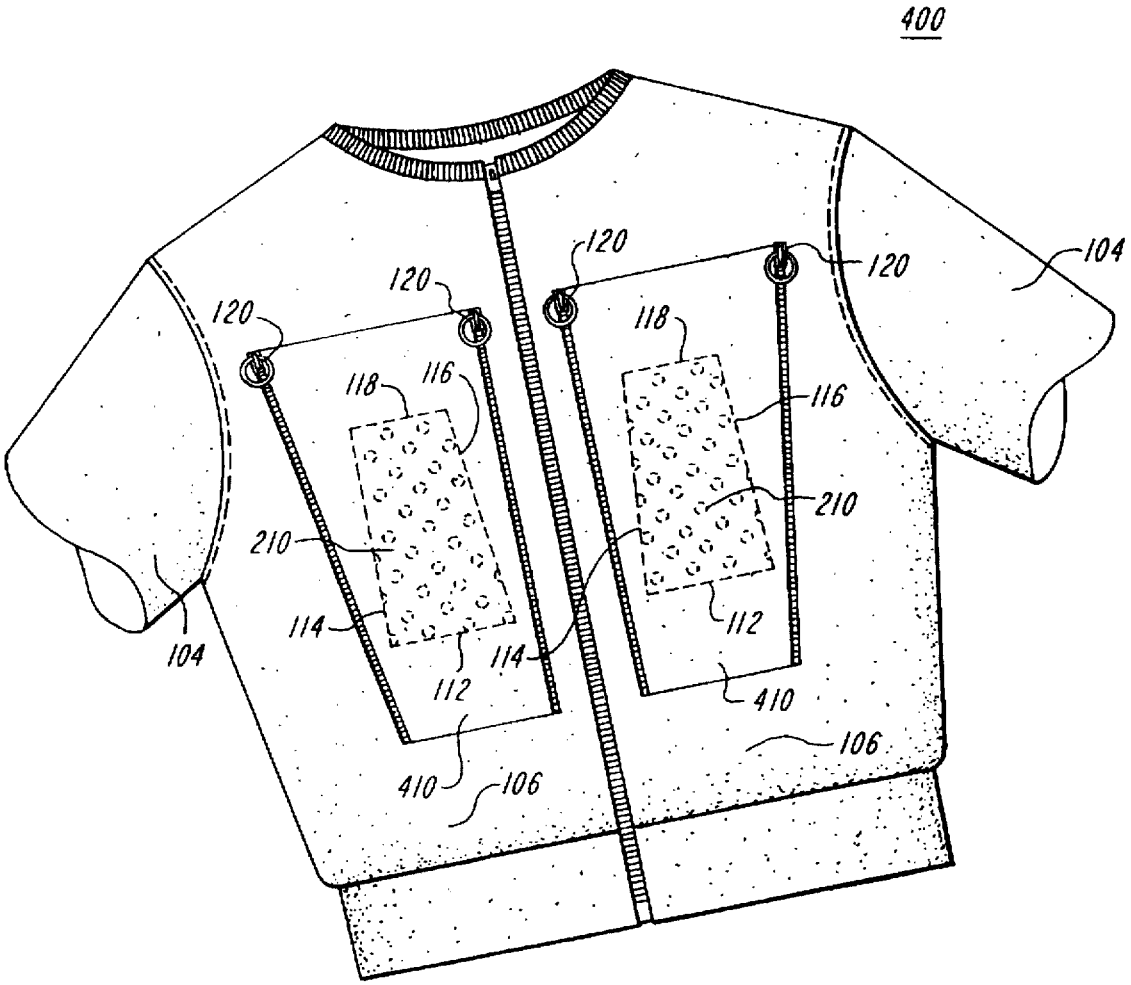
FIG. 4 shows a front view of a jacket according to another embodiment of the present invention.

FIG. 4 shows a front view of another embodiment of a garment 400 according to the invention. The garment 400 is generally similar to the garment 100 shown in FIGS. 1 and 2, and corresponding elements are identified with the same reference designations in FIGS. 1, 2 and 4. The primary difference is that in FIG. 4, cover panels 410 are larger and are not shaped similarly to vent elements 210 (shown in phantom, and underlying cover panels 410). As those skilled in the art will readily appreciate, the cover panels 410 can be formed in a variety of shapes not necessarily corresponding to the shape of the vent elements. Cover panels 410 as shown in FIG. 4 are maximally closed and thereby minimize the air flow through vent elements 210. Vent panels 210 may be exposed, thereby increasing the air flow therethrough, by opening cover panels 410 by means of zippers 120.

It is often desirable to provide protection against air leakage into the interior of the garment 100 when the wearer is traveling at high speeds with the cover panels 110 closed, i.e., fully extended over the vent panels 210.

Figure 5:
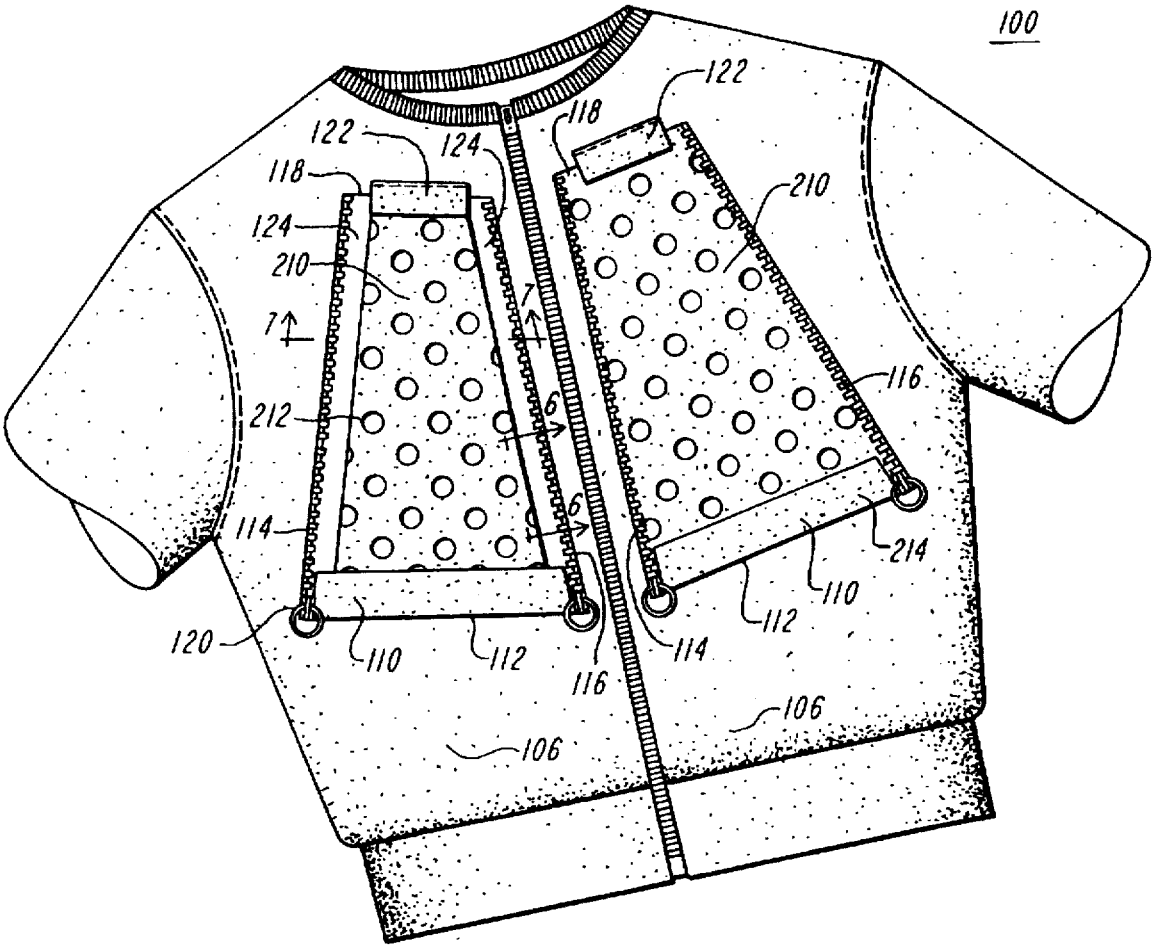
FIG. 5 shows a from view of a jacket according to yet another embodiment of the present invention.
Figure 6:
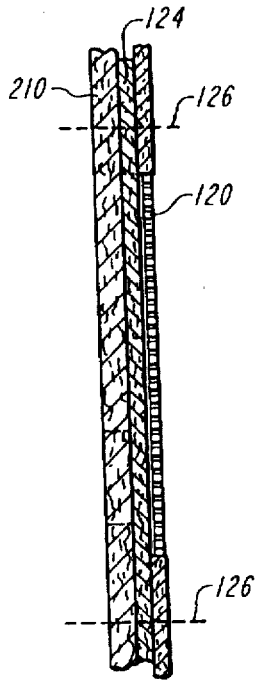
FIG. 6 shows a side sectional view of the front panel and closure element and backing flap of the jacket of FIG. 5.
Figure 7:
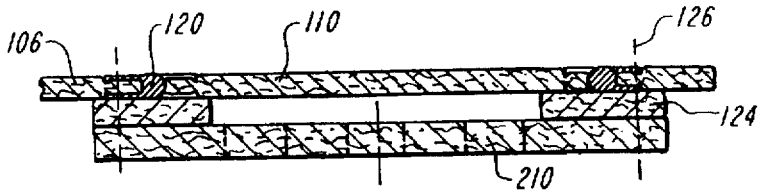
FIG. 7 shows a top sectional view of the front panel cover element, backing flap and closure element of the jacket of FIG. 5.

FIG. 5 shows a front view of a garment 100 according to another embodiment of the invention. In this embodiment, zippers 120 overlie a non-permeable backing flap 124 (shown in the right front panel 106 in FIG. 5). The backing flap 124 lies beneath the zipper 120 and over a portion of the ventilation element 210, as shown in detail in FIGS. 6 and 7. The ventilation element 210, the backing flap 124 and the zipper 120 can all be stitched together with stitching 126 to provide an air-impervious backing to zipper 120 when the zipper 120 is closed and cover element 110 is fully extended over the ventilation element 210, as shown in FIG. 1. The backing flap 124 is preferably made of a non-permeable material, such as vinyl, leather or plastic, which resists penetration by air and moisture.

The backing flap 124 can also be used behind other closure elements, such as buttons or snaps, to improve the garment's resistance to air and moisture leakage when the ventilation elements 210 are fully covered by the cover elements 110.

While the above embodiments of the invention each include two front panels, each having a vent, and a rear panel having a vent, it will be understood that various configurations with differing numbers of panels and vents may be used in keeping with the invention. Also, the cover element as shown is preferably constructed of a non-stretchable material, but in other configurations, it may be stretchable since the vent elements provide the structural stability for the garment.

Figure 8:
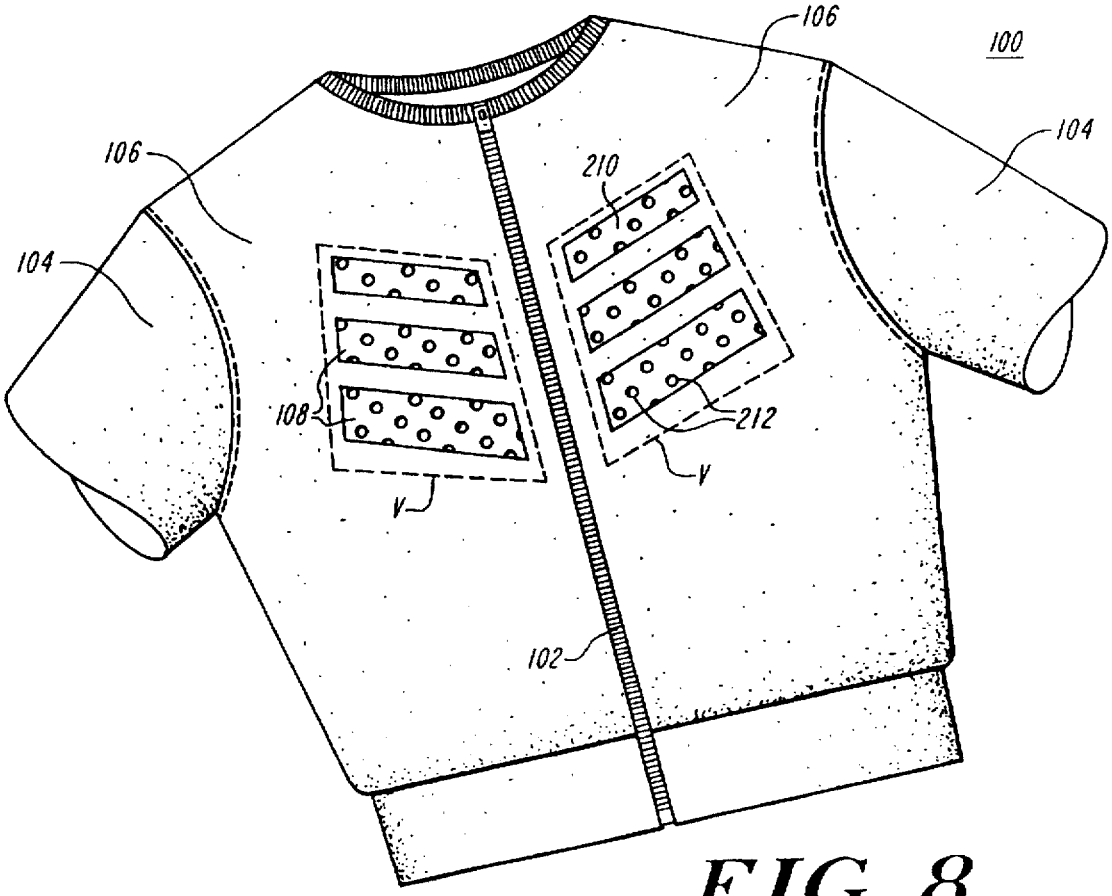
FIG. 8 shows a front view of a jacket according to another embodiment of the present invention.

FIG. 8 shows an alternate construction of the front of a ventilated garment of the present invention. Illustrated is a jacket 100 having central zipper 102, arms 104 and two front panels 106. Each front panel includes a substantially non-stretchable outer panel which includes a vent region (denoted by dashed line V in FIG. 8) surrounding one or more openings 108 which can be of any size and shape to permit entry of air into the interior of the jacket 100. Ventilation elements 210 span each opening 108. The ventilation elements 210 include perforations 212 which provide an air flow path through the ventilation elements 210. As previously described, the ventilation element is preferably made of an air permeable, relatively non-stretchable sheet material, such as, for example, perforated leather or vinyl. In the preferred embodiment, the ventilation elements 210 are joined to the inside of the front panels 106 by stitching (not shown in FIG. 8) or other means. Also, in the preferred embodiment, optional mesh element 192 underlies the ventilation elements 210.

Figure 9:
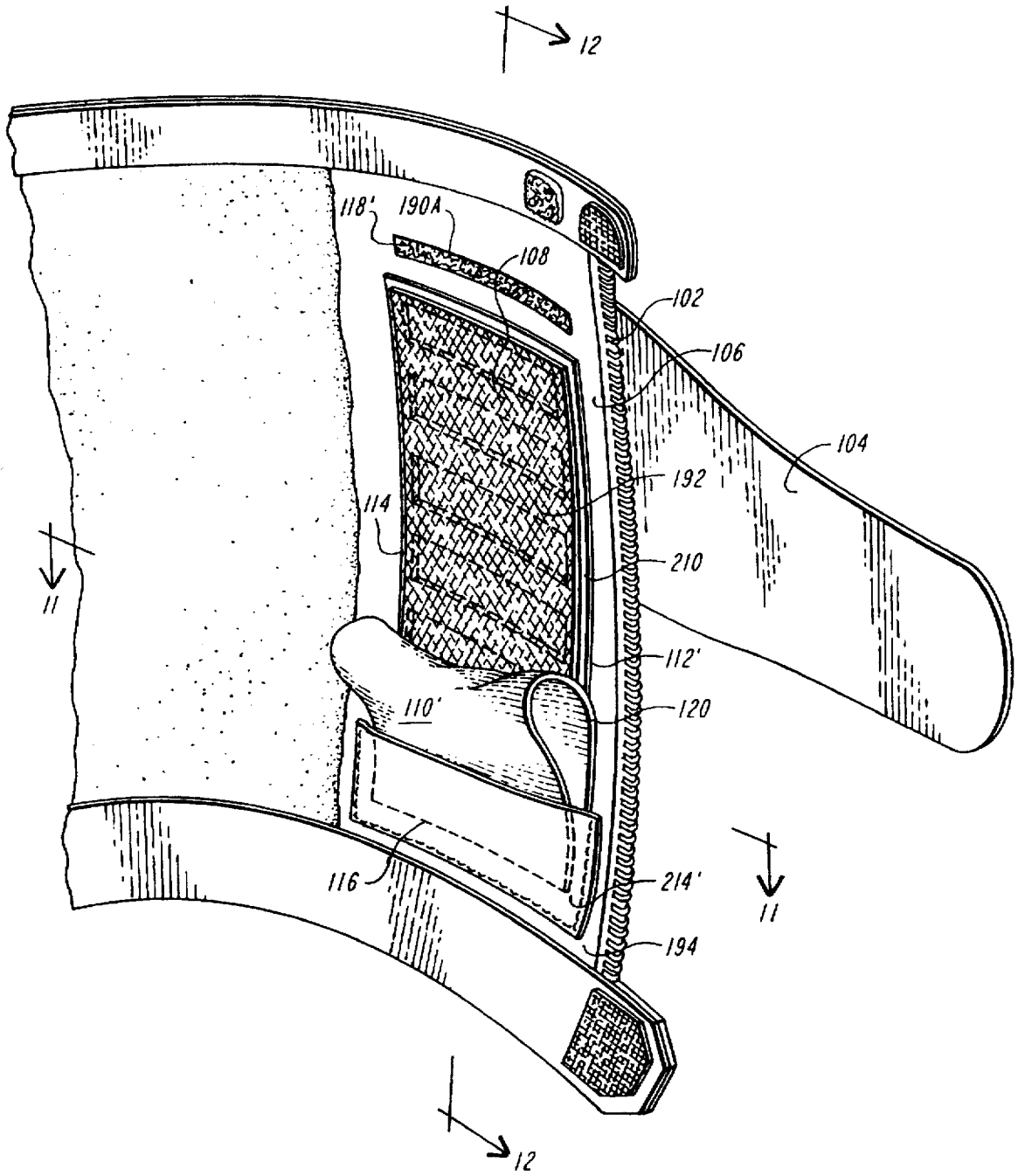
FIG. 9 shows a front view of the inside front panel of the jacket of FIG. 8.

FIG. 9 illustrates the inside of front panel 106 of the jacket 100. An air impermeable lining sheet 194 is attached to the inside panel of 106. Sheet 194 has a central void region (defined by edges 112', 114', 116' and 118') and central void region is substantially in registration with the vent region.

Cover panel 110' is affixed to the lining 194 of the jacket for adjustable positioning over the void region, and thus vent opening 108, ventilation element 210, and mesh element 192. Preferably, cover panel 110' is stitched at edge 116' to the inside lining 194 and selectively attached at edges 114' and 112' with closure elements 120, illustrated as zippers. In another embodiment, the cover element 110' may be fully removable from the lining 194. As shown in FIG. 9, cover element 110' can be adjustably positioned over all vent openings 108 or only a portion thereof by raising or lowering the zippers 120. When the zippers are lowered to expose more of the vent openings 108, thereby permitting air to flow therethrough into the jacket to cool the wearer, cover element 110' can be easily tucked inside a pocket 214' located at a lower portion of the front panel 106. The zippers can be raised to their highest position to fully cover the vent openings 108 with the cover panel 110'. At this cover panel position, the cover panel 110' can be sealed to the inside lining 194 by means of a separate closure 190, illustrated in FIG. 9 as a hook and loop fastener, such as a VELCRO™ fastener. The closure element can also be any other type of closure means, such as a snap, button, zipper or the like, which will provide a relatively air-impervious seal to the cover element 110' when it is fully extended over vent openings 108.

Figure 10A:
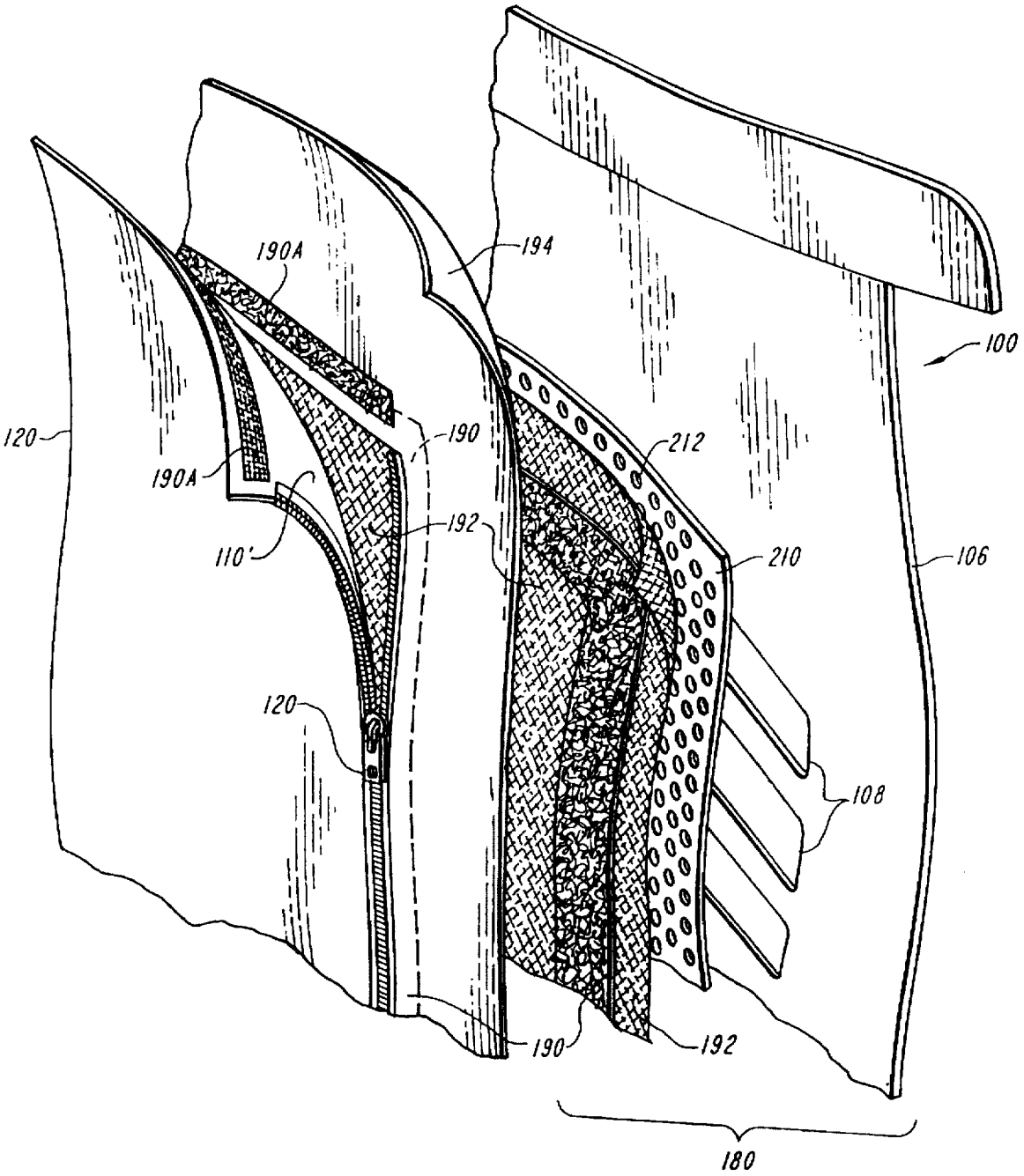
FIG. 10A shows an exploded view of the inside front panel and flap closure of the jacket of FIG. 8.
Figure 10B:
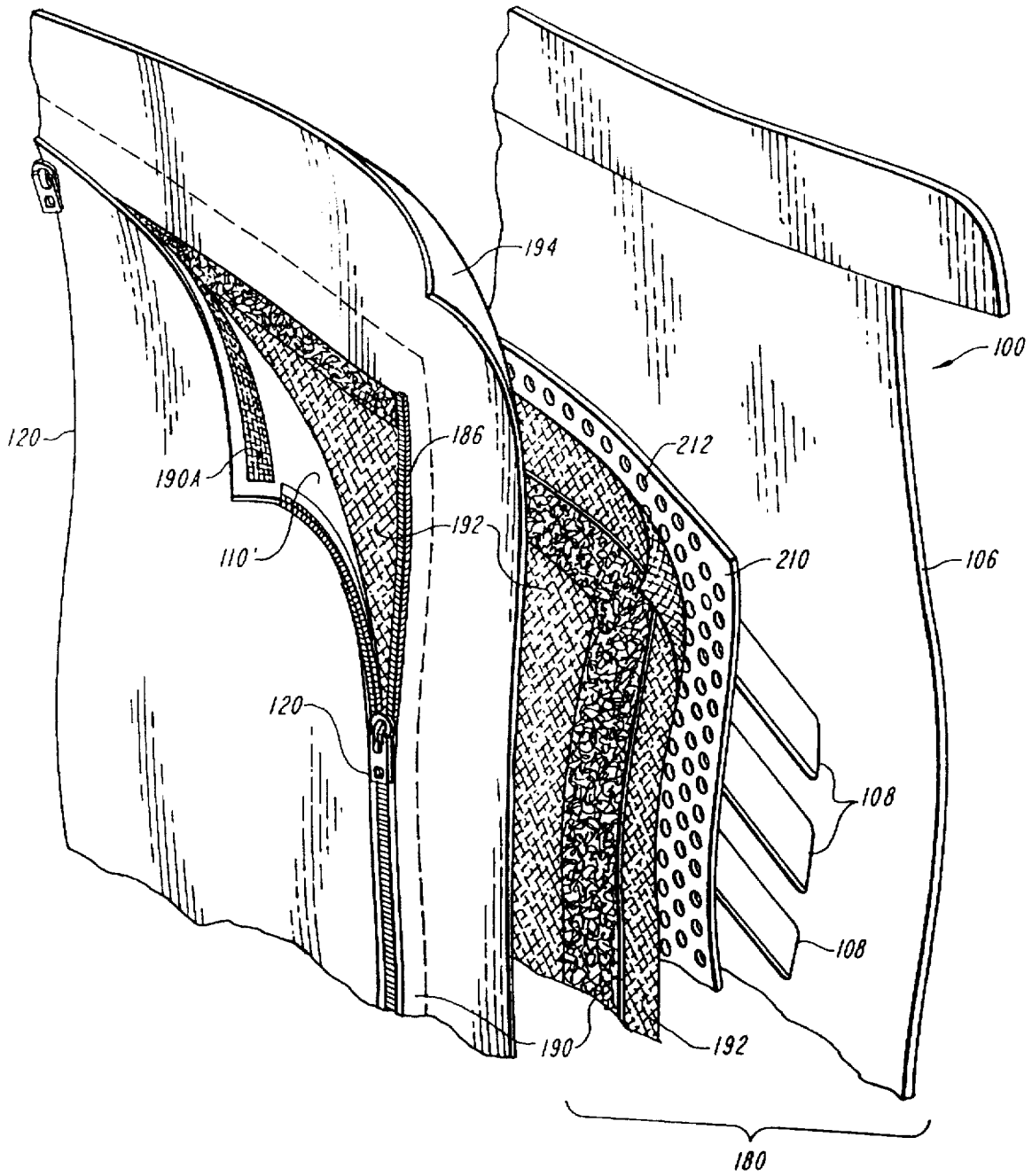
FIG. 10B shows a different cover element closure arrangement from that shown in FIG. 10A.

FIGS. 10A and 10B are exploded views which illustrate the construction of two similar embodiments of the ventilated garment shown in FIGS. 8 and 9. As shown in FIGS. 10A and 10B front panel 106 includes three vent openings 108 for permitting air flow into the garment. Affixed over the area of the vent openings 108 on the inside of front panel 106 is a ventilation element 210 with perforations 212. From the outside of the garment the vent openings reveal the perforated ventilation element 210, which is useful in permitting airflow through the vent openings 108 while preventing the entry of large debris, bugs and the like. Optionally, as illustrated in FIGS. 10A and 10B, an air permeable, lightweight mesh element 192 can be affixed to the ventilation element 210 with stitching (not shown) to sandwich the ventilation element 210 between the inside front panel 106 and the mesh element 192. The air permeable lightweight mesh element 192 can be, for example, a nylon mesh fabric or other breathable material.

A peripheral closure element 190, such as a hook and loop fastener, is affixed to the perimeter of the vent region of panel 106 and the void region of lining 194, so that the void region-defining edges of panel 106 may be effectively bonded to the vent region-defining edges of lining 194. The outer panel construction 180 thus comprises, from the outside of the garment 100 to the inside, outer panel 106 with vent openings 108 therein, an underlying perforated ventilation element 210, an optional underlying lightweight, air permeable mesh fabric 192, and a closure element 190 bounding the edges thereof.

It can be seen in FIGS. 10A and 10B that the ventilation element 210 is preferably a single sheet which is sized to extend fully over all the vent openings 108 in outer panel 106, regardless of the size and/or location of the vent openings 108 in the vent region of outer panel 106. This construction provides greater design flexibility and aesthetic appeal than has been attainable heretofore because the arrangement of vent openings 108 in the garment 100 can vary greatly according to taste and style without affecting the ventilating function of the garment. Further, the garment has a sleek appearance resulting from the placement of the adjustable cover panel 110' on the inside of the jacket instead of on the outside.

The inner lining 194 of the garment is made of a lightweight, nonpermeable material, such as nylon. The vent panel comprises lining 194 having central void region 186. The adjustable cover element 110' is sized to selectively fit over the void region 186 and to be adjustably affixed thereover by means of closure elements 120, which can be a zipper.

As previously described, the zipper 120 can be selectively raised or lowered for adjustably controlling the placement of cover panel 110' over vent openings 108, thereby permitting adjustable control over the ventilation of the garment 100. The top edge of the cover panel 110' can be affixed to a corresponding top edge of the lining 194, such as a mating set of hook and loop fastener strips 190A or by one or more snaps, buttons or the like.

In FIG. 10A the top edge of the cover panel 110' is affixed to a separate closure element 190A attached to the lining 194. In an alternative design, shown in FIG. 10B, a hook strip 190A at the top edge of the cover panel 110' is affixed to the loop strip 190 which is part of the outer panel construction 180. This latter design reduces bulk in the garment by eliminating fabric required by the use of an additional closure element, and requires fewer assembly steps. The cover panel 110' of the latter design is simply shortened by an appropriate amount so that the top edge thereof extends through the vent panel opening 186 to engage with closure element 190 of the outer panel construction 180.

Figure 11A:
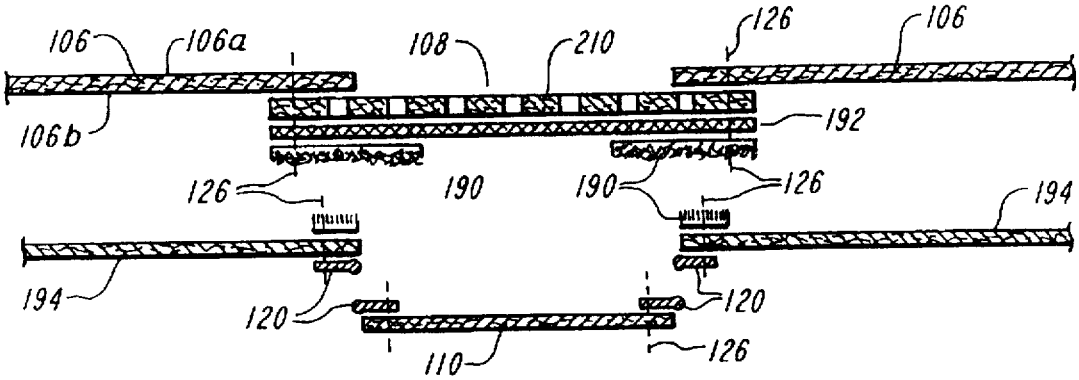
FIG. 11A shows a horizontal sectional view along line 11—11 of the inside outer panel of FIG. 9.
Figure 11B:
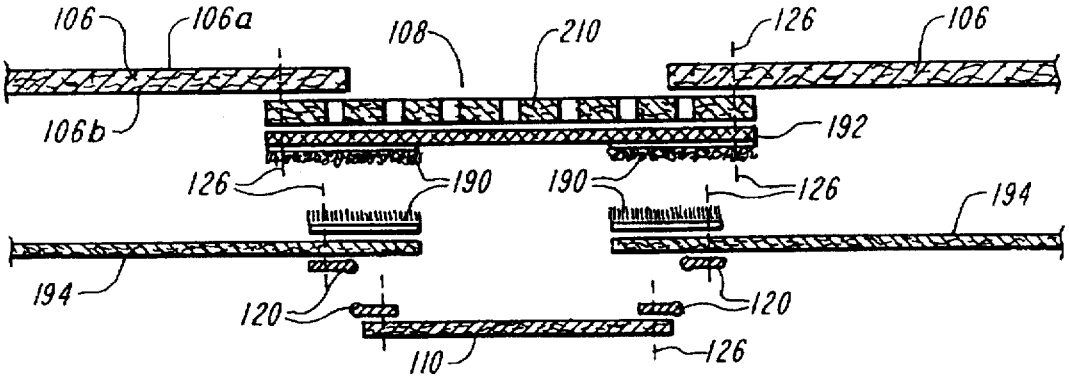
FIG. 11B shows the horizontal sectional view of FIG. 11A with relatively wide closure elements 190 to enhance the fluid impermeability of the garment.
Figure 11C:
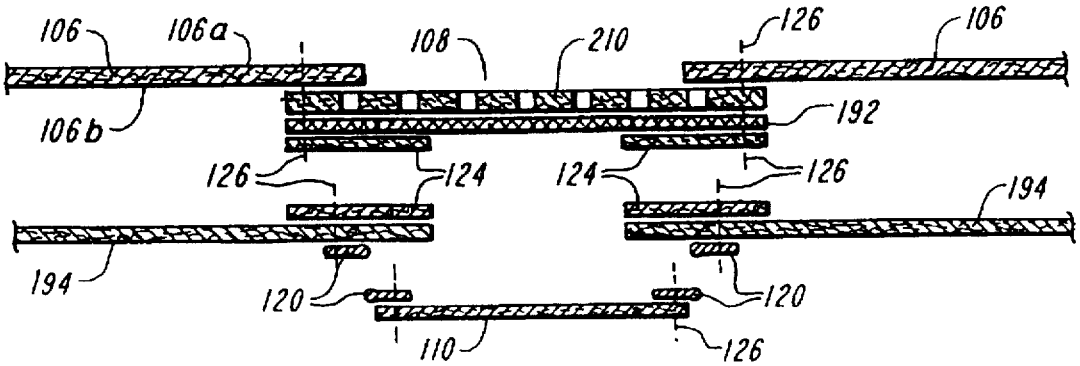
FIG. 11C shows the horizontal sectional view of FIG. 11A with backing flaps 122 in place of the closure elements 190.

FIGS. 11A–11C illustrate horizontal sectional views along lines 11—11 of the garment shown in FIG. 9. Vent opening 108 in outer panel 106 is spanned by ventilation material 210 affixed to the inner surface 106*b* thereof. A lightweight air permeable mesh 192 is optionally joined to the periphery of (or extends beyond) the vent region 108 and ventilation material 210 with stitching 126.

The loop portion of a hook and loop fastener element 190 is affixed to the periphery of vent region 108 via the ventilation material 210 and optional air permeable mesh fabric 192. The hook portion of the hook and loop fastener element 190 is affixed to the air impermeable lining 194.

Cover panel 110', having adjustable closure elements 120 along opposite sides thereof, is adjustably affixed to the lining 194 via closure elements 120. Stitching 126 bonds the various affixed elements to one another.

As shown in FIG. 11B, the closure element strip 190 is preferably sufficiently wide to assist in sealing the perimeter edges of the ventilation element 210 against air leakage around the edges thereof. As shown in FIG. 11C, the closure element 190 can comprise a fluid-impervious backing flap 124 which is stitched via stitching 126 to either the outer panel 106 (via ventilation element 210 and optional mesh element 192), or to the lining 194, or to both the outer panel 106 and the lining 194.

Figure 12B:
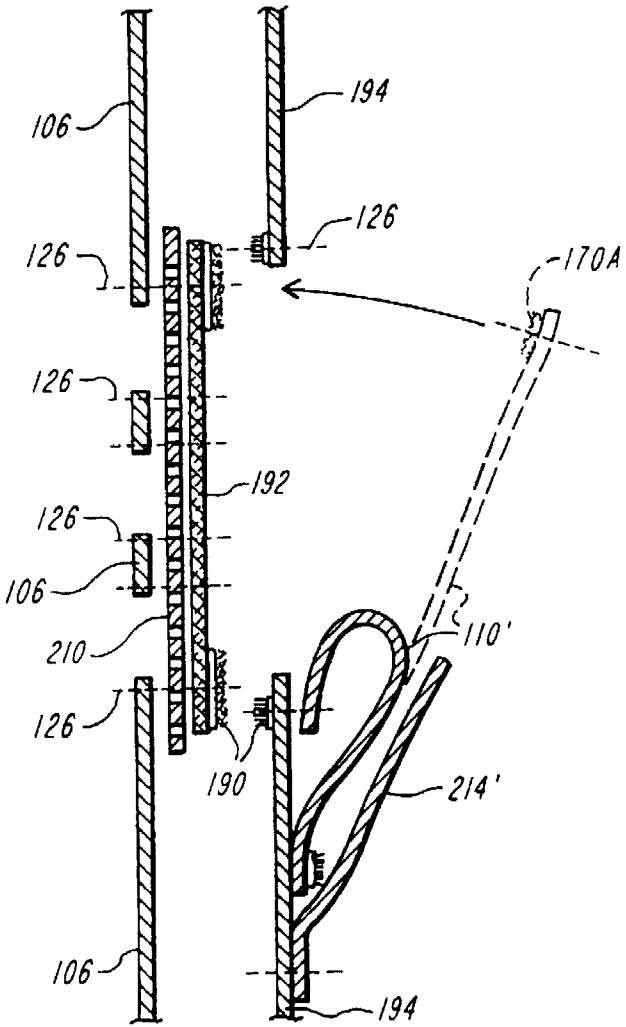
FIG. 12B shows an alternate configuration for the cover element closure shown in FIG. 12A.
Figure 12A:
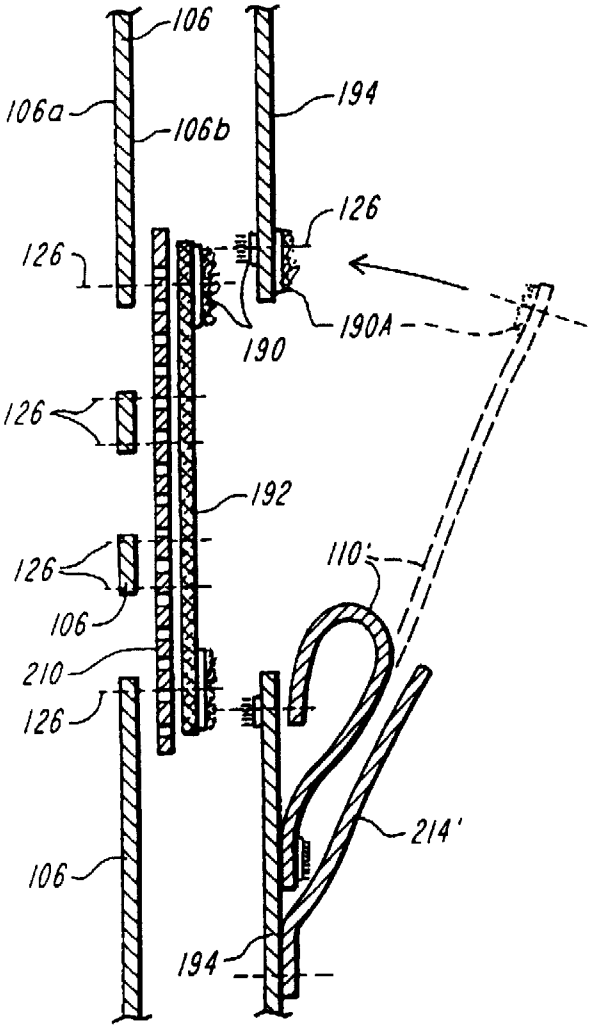
FIG. 12A shows a vertical sectional view along line 12—12 of the inside front panel of FIG. 9.

FIGS. 12A and 12B illustrate vertical sectional views along lines 12—12 of the garment of FIG. 9. In FIG. 12A, the cover panel 110' is affixed at a top edge thereof to lining 194 with a separate hook and loop fastener 190A. In contrast, FIG. 12B shows the cover panel 110' affixed to the same loop portion of the hook and loop fastener 190A which joins the lining 194 to the periphery of the vent region 108 via ventilation element 210 and optional mesh fabric 192. Pocket 214' receives a portion of cover panel 110' when closure elements 120 are lowered to expose a greater portion of the vent region 108, and permit airflow into the garment 100.

Figure 13:
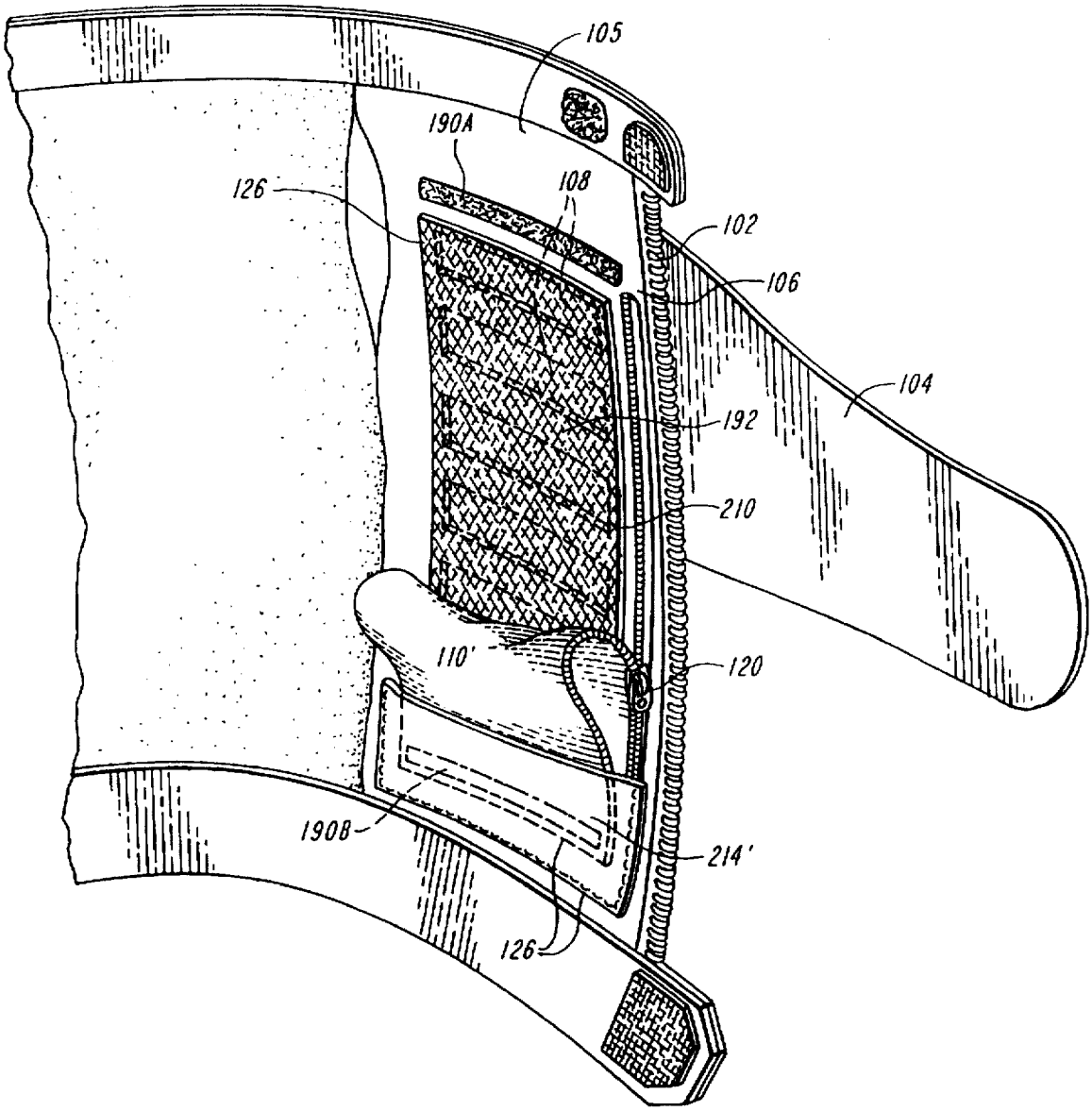
FIG. 13 shows a front view of the inside front panel of a ventilated garment according to still another embodiment of the invention.

FIG. 13 illustrates an alternative construction of the front panel of a ventilated garment according to another embodiment of the present invention. As previously described in connection with the description of the embodiment of FIG. 9, the cover panel 110' is located on the interior of the front panel 106 of the garment. However, unlike the embodiment of FIG. 9, the cover panel 110' is affixed directly to the inner surface 105 of the front panel 106 and is not attached to a lining, such as lining 194, shown in FIG. 9. A portion of the cover panel 110' is affixed to the inner surface 105 of the front panel 106 with stitching 126 or other substantially permanent means. Zippers 120 or other similar adjustable closure elements are also affixed to the inner surface 105 of the front panel 106 with stitching 126 and extend along opposite sides of the cover panel 110', as shown in FIG. 13. A third closure element 190A, which is illustrated in FIG. 13 as a hook-and-loop fastener strip, is preferably located near a top portion of the vent region. A corresponding strip of hook-and-loop fastening material 190B is located near a top portion of the cover panel 110' for engagement with the hook-and-loop fastener strip 190A. Pocket 214' is also affixed directly to the inner surface 105 of front panel 106 with stitching 126 or other like affixation means known in the art.

Figure 14:
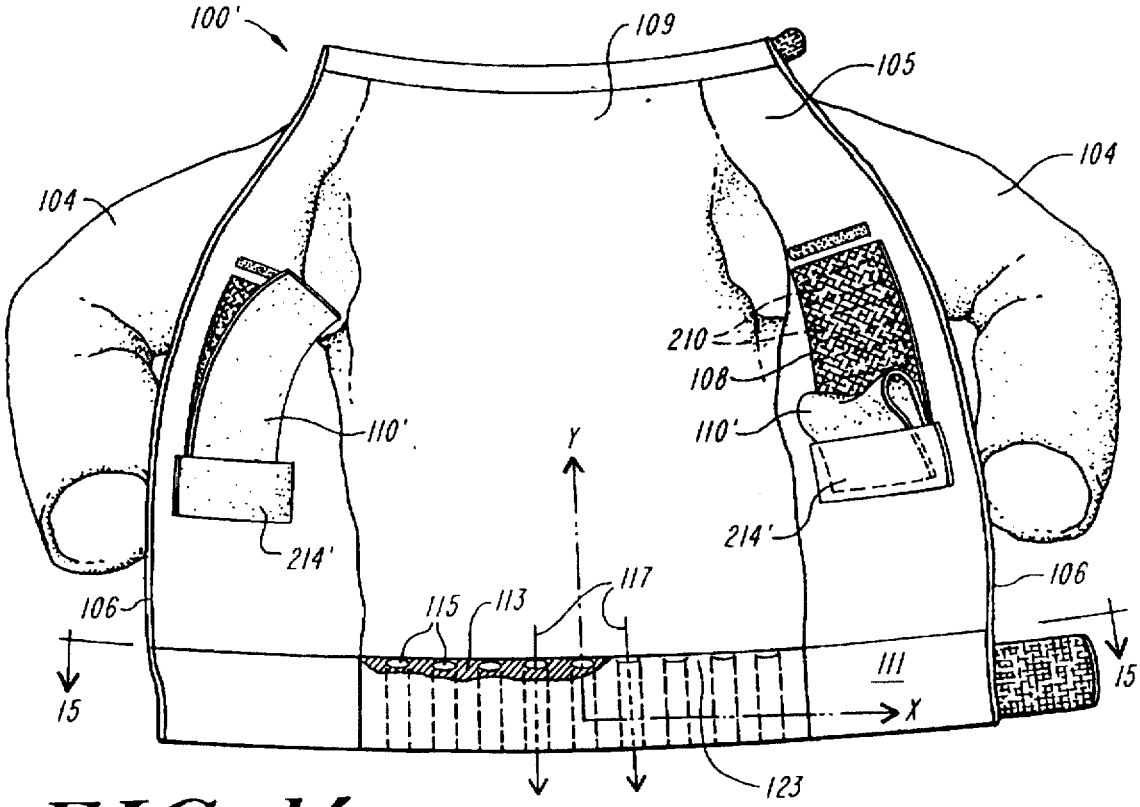
FIG. 14 shows a from view of the inside of a ventilated garment having a vent panel extending from the rear panel according to still another embodiment of the present invention.

FIGS. 14–16 illustrate various aspects of another embodiment of the present invention. As shown in FIG. 14, a ventilated garment 100' has outer front panels 106, outer rear panel 109 and sleeves 104. The front panels 106 and rear panel 109 are disposable about and define an interior region R. The outer front panel 106 forms at least a portion of the front of the garment and includes a vent 108 for permitting airflow through the front panel 106 into the interior region R. The rear panel 109 forms at least a portion of the back of the garment. A vent panel 111 extends from the outer back panel 109 along a principal plane defined by intersecting axes X,Y, as illustrated most clearly in FIG. 14. The vent panel 111 includes means for establishing an air flow path 113 through the vent panel 111 substantially along the principal plane X,Y of the vent panel from the interior region R to points exterior to the garment.

In a preferred embodiment, vent openings 108 in the front panel 106 are spanned with non-stretchable, air permeable vent panels 210 and permit air to flow into the garment. Cover panel 110' is affixed either to the inner surface 105 of the front panel 106 or to an air impermeable lining (not shown in FIG. 14) attached to the interior of the garment.

The vent panel 111 includes a substantially incompressible channeled structure 113 having channels or passageways 115 for establishing an air flow path through the vent panel 111 in the direction of arrows 117. The channeled structure 113 is preferably made of a relatively rigid, incompressible material which has channels or passageways 115 extending through it in a direction substantially parallel to the principal plane of the vent panel.

Figure 20B:
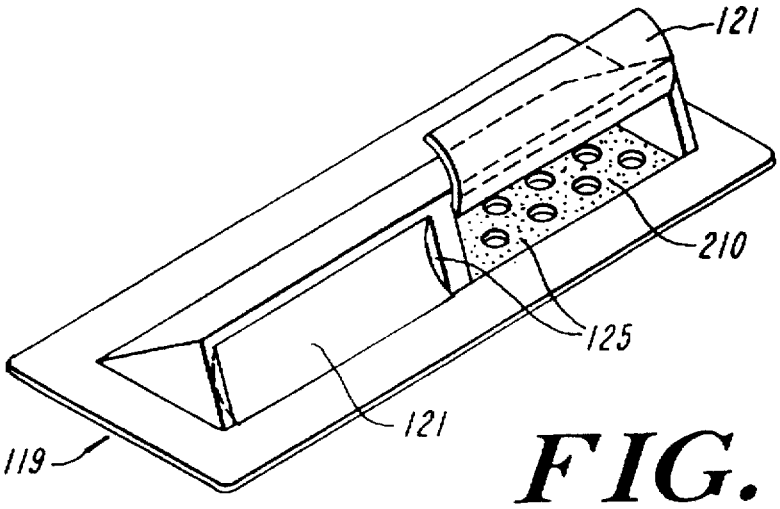
Figure 21:
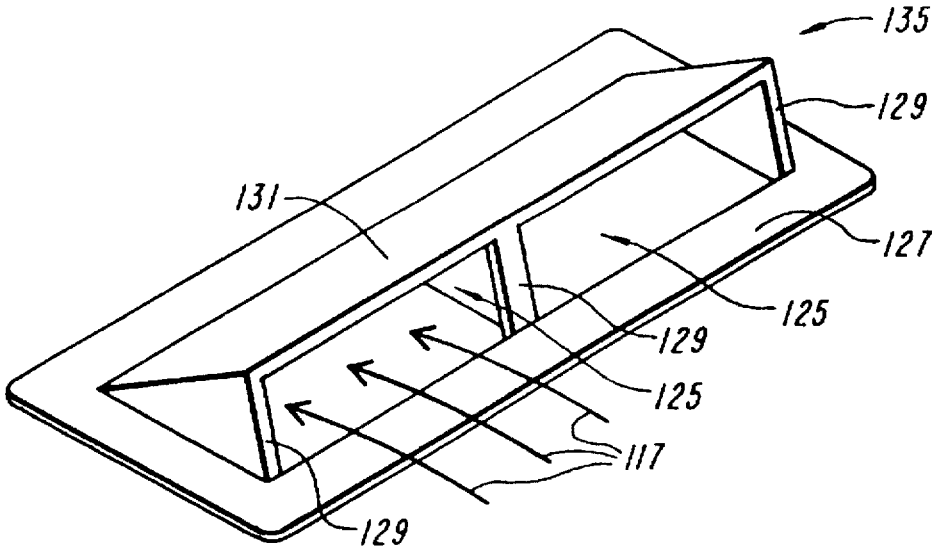
FIG. 21 is a front perspective view of an air flow scoop element.

Although the vent panel 111 in FIGS. 14–16 is shown as extending only a short distance along the plane defined by intersecting axes X,Y, the vent panel 111 can extend up through the rear panel 109 to near the shoulders of the garment, as shown in FIGS. 17–18. Airflow scoop elements 119, illustrated in FIGS. 20A–B and 21, are located near the shoulders on front panels 106 or on rear panel 109, as shown in FIG. 18, and permit airflow into the garment around the wearer's body or through the airflow paths 113 along the rear panel of the garment. Adjustable closure elements 123 on the inside of the garment, illustrated in FIG. 14 as one or more zippers, can be used to control the volume of airflow through the vent panel 111.

When the garment 100' is worn, portions of the garment, including the vent panel 111, may be cinched closely to the wearer's body for a snug fit. Entry of air into the garment 100', for example, through the vent openings 108 and vent panels 210, potentially causes the garment to balloon with air entrapped inside. However, in the embodiments of the present invention, the entrapped air travels down over the wearer's body inside the garment and through the air flow channels 115 inside the vent panel 111 to the outside, as illustrated by arrows 117 in FIGS. 14, 16, 17 and 18.

This garment design increases both the aesthetic appeal and the structural integrity of the garment 100' by eliminating the need for airflow exit vents in one or more panels of the garment, such as the rear panel 109. It further provides needed and welcome cooling of the wearer by establishing an air flow path around the wearer's body without creating an unwanted billowing effect.

Figure 15A:
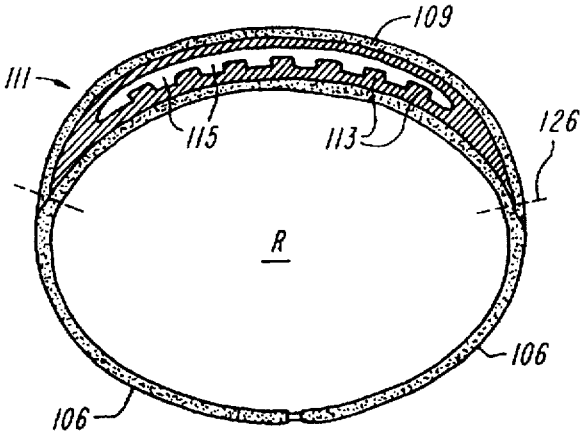
FIG. 15A and 15B are sectional views taken along section lines 15—15 of the garment of FIG. 14, and A—A of FIG. 17, with the front and rear panels extending about and defining an interior region.
Figure 15B:
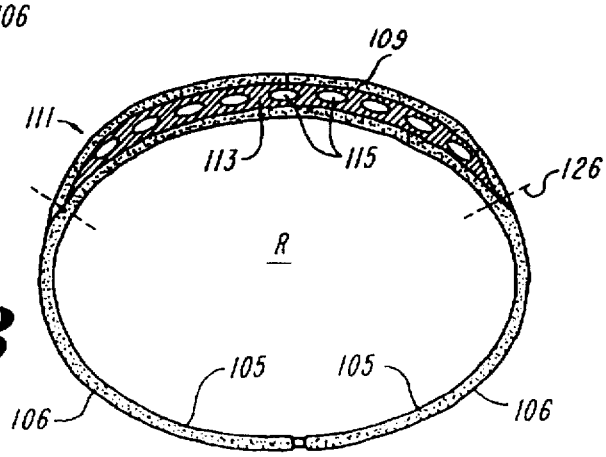

A sectional view of alternate embodiments of the vent panel 111 is illustrated in FIGS. 15A and 15B. The channeled structure 113 is surrounded by fabric or material of suitable construction for use in such garments. The channeled structure 113 is relatively rigid and incompressible so that even when the garment 100' is cinched snugly around the wearer's body, the air flow passageways 115 in the channeled structure 113 remain open to permit unobstructed airflow therethrough along the principal plane of the vent panel. The channeled structure 113 can comprise, for example, a molded plastic or foam structure, as illustrated in FIG. 15A, or a series of relatively rigid, hollow tubular structures, as illustrated in FIG. 15B. The channeled structure 113 is encased in fabric, such as leather, nylon, cotton or the like, so that it does not rub against or chafe the wearer's body or otherwise cause discomfort. It may be additionally protected with layers of insulative fabric to prevent deterioration from moisture, perspiration, abrasion, temperature extremes, and the like.

The relatively rigid and incompressible channeled structure 113, if extended along the plane XY of the rear panel 109, can serve as a protective armor layer for the wearer, as shown in FIG. 17, in the event of a spill from the vehicle. FIGS. 15A and 15B show a sectional view of the channeled structure extending through the rear panel, taken along Section line A—A of FIG. 17. If desired, the channeled structure can be made of a highly thermally conductive material to facilitate heat transfer between the wearer's body and the environment.

The airflow scoop elements 119 can include adjustable closure elements 121 for regulating the airflow through the scoop element 119 and vent panel 111. As shown in FIG. 19, the airflow scoop elements 119 can be affixed to an outer panel 106 or 109 of the garment so that air is permitted to enter the scoop elements during travel. The scoop elements are made of a relatively flexible, lightweight material.

As shown in FIGS. 20A–B, the adjustable closure elements 121 can be, for example, hinged flap elements which are adapted to fit frictionally into the openings 125 of the airflow scoop elements 119 and held in place by the force of airflow against them during travel. The closure elements 121 preferably have a slight curvature to them about an axis L extending transverse to the plane of the airflow scoop openings 125, in order to provide a smooth contour for airflow over them when the closure elements 121 are folded back (i.e., not covering the scoop element openings) to provide a better seal against air leakage therethrough when they are covering the scoop element openings, as shown in FIGS. 20A–B.

FIGS. 20A, 20B and 21 illustrate a flexible vent assembly 135 according to another aspect of the invention. The assembly includes an airflow scoop element 119 having a base portion 127, support ribs 129, rear portion 131 and openings 125 between the ribs, the rear portion and the base portion. It is preferably constructed from a relatively flexible lightweight material, such as rubber or plastic. The openings 125 of scoop elements 119 are spanned with a non-stretchable, air-permeable ventilation material 210 which can be, for example, leather having a plurality of perforations 212. Airflow in the direction of arrows 17 enters the scoop element 119 through openings 125 and travels through the inside of the garment around the wearer's body, exiting the garment through vent panels in the rear of the garment. The airflow scoop element 119 can be attached to the outer panel 106 or 109 of the garment, for example, by stitching 133 around the perimeter of the base portion 127, as shown in FIGS. 19A–B.

Although the embodiments depicted in FIGS. 8–12 and 13–21 are illustrated and described as a ventilated garment, such as, for example, a jacket, it is to be understood that the ventilation assembly of the invention can be embodied in any type of garment in which adjustable, controllable ventilation in an aesthetically appealing design is desired. For example, the present invention could also be constructed within a vest, a full body suit, a pair of protective pants, headwear, footwear, gloves, or the like.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

Having described the invention, what is claimed as new and secured by Letters Patent is:

1. A ventilated garment comprising:

A. at least one substantially non-stretchable outer panel, said outer panel having an inner surface and an outer surface and having a vent region including n openings therein, where n is an integer, said outer panel including substantially non-stretchable, air permeable vent material spanning said openings, B. an air impermeable cover element defined by a periphery and having a shape substantially corresponding to at least a portion of said vent region, and including means for affixing a first portion of said cover element periphery to said inner surface of said outer panel substantially along a first portion of said vent region, and a first adjustable closure element adjustably coupling a second portion of said cover element periphery to said inner surface of said outer panel substantially along a second portion of said inner peripheral boundary, and a second adjustable closure element adjustably coupling a third portion of said cover element periphery to said inner surface of said outer panel substantially along a third portion of said vent region, wherein said second portion and said third portion of said cover element periphery extend substantially from opposite ends of said first portion of said cover element periphery and wherein said second portion and said third portion of said vent region extend substantially from opposite ends of said first portion of said vent region.

2. A ventilated garment according to claim 1 wherein said outer panel is made from a material selected from the group consisting of leather and vinyl.

3. A ventilated garment according to claim 1 wherein said cover element is made from a material selected from the group consisting of leather and vinyl.

4. A ventilated garment according to claim 1 wherein said vent material comprises a perforated material.

5. A ventilated garment according to claim 1 wherein said first and second closure elements comprise zippers.

6. A ventilated garment according to claim 5 further comprising a non-permeable backing flap affixed between said zipper and said vent material and extending transversely over at least a portion of said vent material.

7. A ventilated garment according to claim 1 further including a third closure element for adjustably coupling a fourth portion of said cover element periphery to said inner surface of said outer panel substantially along a fourth portion of said vent region, wherein said fourth portion of said cover element periphery extends substantially between said second and said third portions of said cover element periphery and wherein said fourth portion of said vent region extends substantially between said second portion and said third portion of said vent region.

8. A ventilated garment according to claim 7 wherein said third closure element comprises a hook and loop fastener.

9. A ventilated garment according to claim 1 further comprising a pocket extending from said vent region on said inner surface of said outer panel and substantially adjacent to said first portion of said vent region.

10. A ventilated garment according to claim 1 wherein said means for affixing said cover element to said inner surface of said outer panel comprises a removable affixing element.

11. A ventilated garment according to claim 1 wherein said means for affixing said cover element to said inner surface of said outer panel comprises a permanent affixing element.

12. A ventilated garment having a front and a back disposable about and defining an interior region, said garment comprising:

A. at least one outer front panel forming at least a portion of the front of said garment, said outer front panel including a vent for permitting air flow through said outer front panel into said interior region, B. at least one outer back panel forming at least a portion of the back of said garment, and C. a vent panel extending from said outer back panel along a principal plane, said vent panel including means for establishing an air flow path therethrough substantially along said principal plane from said interior region of said garment to parts exterior thereto.

13. A ventilated garment according to claim 12 wherein said outer front panel is substantially nonstretchable.

14. A ventilated garment according to claim 13 wherein said outer front panel is made from a material selected from the group consisting of leather and vinyl.

15. A ventilated garment according to claim 13 wherein said outer front panel further includes an inner surface and an outer surface, a vent region including n openings therein, where n is an integer, and substantially non-stretchable, air permeable vent material spanning said openings.

16. A ventilated garment according to claim 15 wherein said vent material comprises a perforated material.

17. A ventilated garment according to claim 16 further comprising an air-impermeable cover element defined by a periphery and having a shape substantially corresponding to at least a portion of said vent region, and including means for affixing a first portion of said cover element periphery to said inner surface of said outer panel substantially along a first portion of said vent region, and a first adjustable closure element adjustably coupling a second portion of said cover element periphery to said inner surface of said outer panel substantially along a second portion of said vent region, and a second adjustable closure element adjustably coupling a third portion of said cover element periphery to said inner surface of said outer panel substantially along a third portion of said vent region, wherein said second portion and said third portion of said cover element periphery extend substantially from opposite ends of said first portion of said cover element periphery and wherein said second portion and said third portion of said vent region extend substantially from opposite ends of said first portion of said vent region.

18. A ventilated garment according to claim 17 wherein said cover element is made from a material selected from the group consisting of leather and vinyl.

19. A ventilated garment according to claim 17 wherein said first and second closure elements comprise zippers.

20. A ventilated garment according to claim 19 further comprising a non-permeable backing flap affixed between said zipper and said vent material and extending transversely over at least a portion of said vent material.

21. A ventilated garment according to claim 17 further including a third closure element for adjustably coupling a fourth portion of said cover element periphery to said inner surface of said outer panel substantially along a fourth portion of said vent region, wherein said fourth portion of said cover element periphery extends substantially between said second and said third portions of said cover element periphery and wherein said fourth portion of said vent region extends substantially between said second portion and said third portion of said vent region.

22. A ventilated garment according to claim 21 wherein said third closure element comprises a hook and loop fastener.

23. A ventilated garment according to claim 17 further comprising a pocket extending from said vent region on said inner surface of said outer panel and substantially adjacent to said first portion of said vent region.

24. A ventilated garment according to claim 17 wherein said means for affixing said cover element to said inner surface of said outer panel comprises a removable affixing element.

25. A ventilated garment according to claim 17 wherein said means for affixing said cover element to said inner surface of said outer panel comprises a permanent affixing element.

26. A ventilated garment according to claim 16 further comprising:

A. an air impermeable lining sheet having an outer peripheral boundary defining the outer bounds of said sheet and having an inner peripheral boundary defining a central void region substantially corresponding in shape to said vent region and having a surround region extending omnidirectionally from said central void region to said outer peripheral boundary, said surround region being affixed along said outer peripheral boundary to said inner surface of said outer panel whereby said central bold region is substantially in registration with said vent region, B. an air-impermeable cover element defined by a periphery and having a shape substantially corresponding to at least a portion of said vent region, and including means for affixing a first portion of said cover element periphery to said air impermeable lining sheet substantially along a first portion of said inner peripheral boundary, and a first adjustable closure element adjustably coupling a second portion of said cover element periphery to said air impermeable lining sheet substantially along a second portion of said inner peripheral boundary, and a second adjustable closure element adjustably coupling a third portion of said cover element periphery to said air impermeable lining sheet substantially along a third portion of said inner peripheral boundary, wherein said second portion and said third portion of said cover element periphery extend substantially from opposite ends of said first portion of said cover element periphery and wherein said second portion and said third portion of said inner peripheral boundary extend substantially from opposite ends of said first portion of said inner peripheral boundary, and C. coupling means for coupling said inner peripheral boundary of said air impermeable lining sheet to correspondingly positioned portions of said inner surface of said outer panel.

27. A ventilated garment according to claim 26 wherein said cover element is made from a material selected from the group consisting of leather and vinyl.

28. A ventilated garment according to claim 26 wherein said first and second closure elements comprise zippers.

29. A ventilated garment according to claim 28 further comprising a non-permeable backing flap affixed between said zipper and said vent material and extending transversely over at least a portion of said vent material.

30. A ventilated garment according to claim 26 further including a third closure element for adjustably coupling a fourth portion of said cover element periphery to said inner surface of said outer panel substantially along a fourth portion of said vent region, wherein said fourth portion of said cover element periphery extends substantially between said second and said third portions of said cover element periphery and wherein said fourth portion of said vent region extends substantially between said second portion and said third portion of said vent region.

31. A ventilated garment according to claim 30 wherein said third closure element comprises a hook and loop fastener.

32. A ventilated garment according to claim 26 further comprising a pocket extending from said vent region on said inner surface of said outer panel and substantially adjacent to said first portion of said vent region.

33. A ventilated garment according to claim 26 wherein said means for affixing said cover element to said inner surface of said outer panel comprises a removable affixing element.

34. A ventilated garment according to claim 26 wherein said means for affixing said cover element to said inner surface of said outer panel comprises a permanent affixing element.

35. A ventilated garment according to claim 26 wherein said means for establishing air flow path through said vent panel comprises a substantially incompressible structure having at least one air flow channel extending through said vent panel along said principal plane.

36. A ventilated garment according to claim 35 wherein said means for establishing an air flow path through said vent panel comprises at least one substantially incompressible tube extending through said vent panel along said principal plane.

37. A ventilated garment according to claim 12 wherein said vent panel and said outer back panel are integrally formed.

38. A ventilated garment according to claim 12 wherein said vent panel and said outer back panel are discrete panels.

39. A ventilated garment according to claim 12 wherein said means for establishing air flow through said vent panel comprises a substantially incompressible structure having at least one air flow channel extending along said principal plane through said vent panel.

40. A ventilated garment according to claim 39 wherein said means for establishing an airflow through said vent panel comprises at least one substantially incompressible tube extending along said principal plane through said vent panel.

41. A ventilated garment according to claim 12 wherein said means for establishing airflow through said vent panel further includes:

(i) at least one airflow scoop element affixed to an outer panel of said garment and having at least one opening in fluid connection with said vent panel, and (ii) at least one adjustable closure element.

42. A ventilated garment according to claim 41 wherein said adjustable closure element comprises a zipper disposed near said vent panel distally from said airflow scoop element for adjustably controlling airflow through said vent panel.

43. A ventilated garment according to claim 41 wherein said adjustable closure element comprises a selectively engageable flap element disposed near said airflow scoop element for adjustably controlling airflow through said scoop element.

44. A ventilated garment according to claim 41 wherein said opening of said airflow scoop element is spanned by an air-permeable, non-stretchable vent material.

45. A ventilated garment according to claim 41 wherein said airflow scoop element is affixed to an outer front panel of said garment.

46. A ventilated garment according to claim 41 wherein said airflow scoop element is affixed to an outer rear panel of said garment.

47. A ventilated garment according to claim 41 wherein said airflow scoop element is made of a flexible material.

48. A ventilated garment according to claim 47 wherein said opening of said airflow scoop element is spanned by an air-permeable, non-stretchable vent material.

49. A flexible vent assembly, comprising:

A. an airflow scoop element disposed on an outer panel of a garment and adapted for admitting air into said garment, said airflow scoop element having a base portion, a rear portion, a plurality of support ribs, and at least one opening between said ribs, said rear portion and said base portion for permitting fluid flow therethrough, said airflow scoop element being made of a flexible material; and B. an air-permeable, non-stretchable vent material spanning said opening of said airflow scoop element.

50. A ventilated garment according to claim 12, wherein said means for establishing an air flow path through said vent panel substantially along said principal plane comprises a substantially incompressible channeled structure having a plurality of channels or passageways for establishing an air flow path through the vent panel substantially parallel to the principal plane of the vent panel.

* * * * *